US009864294B2

(12) United States Patent
Saegusa

(10) Patent No.: US 9,864,294 B2
(45) Date of Patent: Jan. 9, 2018

(54) RESIN COMPOSITION, ELECTROSTATIC CHARGE IMAGE DEVELOPING TONER, AND ELECTROSTATIC CHARGE IMAGE DEVELOPER

(71) Applicant: FUJI XEROX CO., LTD., Tokyo (JP)

(72) Inventor: Hiroshi Saegusa, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/202,202

(22) Filed: Jul. 5, 2016

(65) Prior Publication Data

US 2017/0227879 A1 Aug. 10, 2017

(30) Foreign Application Priority Data

Feb. 4, 2016 (JP) ..... 2016-020079

(51) Int. Cl.
*G03G 9/08* (2006.01)
*G03G 9/135* (2006.01)
(Continued)

(52) U.S. Cl.
CPC ..... *G03G 9/1355* (2013.01); *G03G 9/08771* (2013.01); *G03G 9/09758* (2013.01)

(58) Field of Classification Search
CPC ..... G03G 9/08771; G03G 9/09758; G03G 9/09775
(Continued)

(56) References Cited

U.S. PATENT DOCUMENTS 5,405,976 A 4/1995 Telfer et al.
5,627,014 A 5/1997 Chu et al.
(Continued)

FOREIGN PATENT DOCUMENTS

JP H02-118670 A 5/1990
JP H05-505641 A 8/1993
(Continued)

*Primary Examiner* — Mark A Chapman
(74) *Attorney, Agent, or Firm* — Oliff PLC

(57) ABSTRACT

A resin composition includes at least one selected from compounds represented by formula (I-1) and at least one selected from compounds represented by formula (I-2) and compounds represented by formula (I-3):

Formula (I-1)

Formula (I-2)

Formula (I-3)

Formula (a1)

Formula (a2)

wherein $R^{11}$ to $R^{14}$, $R^{21}$ to $R^{24}$, and $R^{31}$ to $R^{34}$ independently represent a hydrogen atom, an alkyl group, an alkoxy group, an aryl group, or an aralkyl group, $R^{15}$, $R^{16}$, $R^{25}$, $R^{26}$, $R^{35}$, and $R^{36}$ independently represent a hydrogen atom or an alkyl group, X and Y independently represent an oxygen atom, a (Continued)

sulfur atom, a selenium atom, or a tellurium atom, with the proviso that plural X's each represent the same element, plural Y's each represent the same element, which is an element different from the element selected as X, $A^1$ to $A^3$ independently represent a divalent group represented by formula (a1) or (a2), which is bonded at the * positions.

7 Claims, 1 Drawing Sheet

(51) Int. Cl.
*G03G 9/087* (2006.01)
*G03G 9/097* (2006.01)

(58) Field of Classification Search
USPC ..... 430/108.5, 109.5
See application file for complete search history.

(56) References Cited

U.S. PATENT DOCUMENTS

| | | | | |
|---|---|---|---|---|
| 5,977,351 | A | 11/1999 | Chu et al. | |
| 2008/0241762 | A1* | 10/2008 | Fukui ..... | G03C 1/49854 430/322 |
| 2010/0203437 | A1 | 8/2010 | Yanagida | |
| 2013/0189611 | A1 | 7/2013 | Tian et al. | |

FOREIGN PATENT DOCUMENTS

| | | | |
|---|---|---|---|
| JP | 2007-169315 | A | 7/2007 |
| JP | 2010-186014 | A | 8/2010 |
| JP | 2013-147595 | A | 8/2013 |
| JP | 2014-153621 | A | 8/2014 |

* cited by examiner

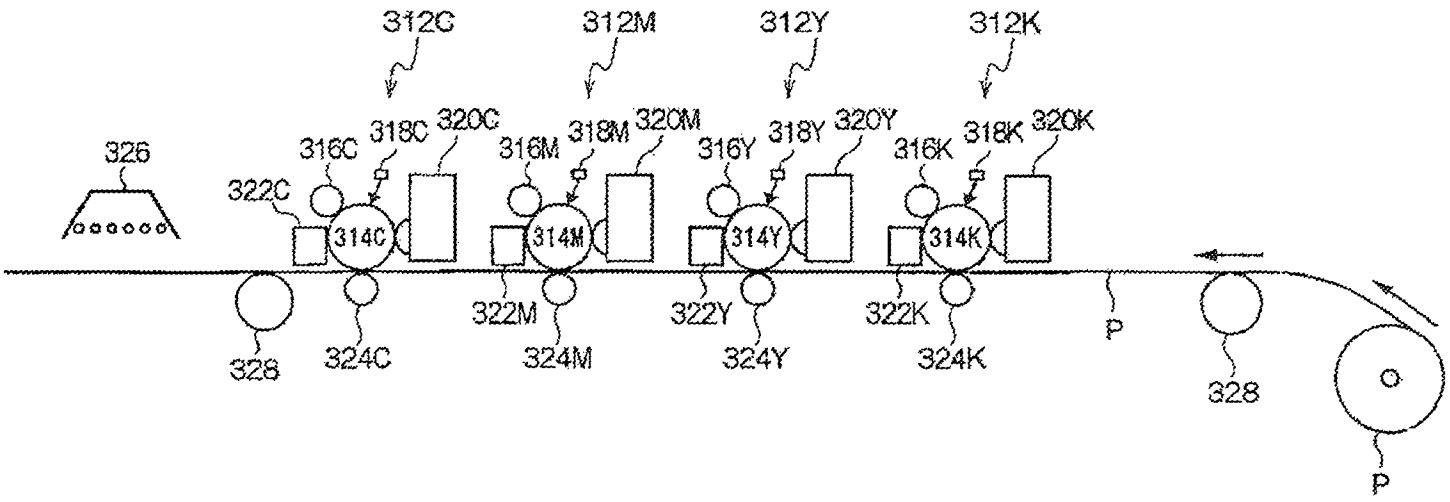
312K
312Y
312M
312C
320K
320Y
320M
320C
318K
318Y
318M
318C
316K
316Y
316M
316C
314K
314Y
314M
314C
322K
322Y
322M
322C
324K
324Y
324M
324C
326
328
328
P
P

RESIN COMPOSITION, ELECTROSTATIC CHARGE IMAGE DEVELOPING TONER, AND ELECTROSTATIC CHARGE IMAGE DEVELOPER

CROSS-REFERENCE TO RELATED APPLICATIONS

This application is based on and claims priority under 35 USC 119 from Japanese Patent Application No. 2016-020079 filed Feb. 4, 2016.

BACKGROUND

1. Technical Field

The present invention relates to a resin composition, an electrostatic charge image developing toner, and an electrostatic charge image developer.

2. Related Art

In image formation according to an electrophotographic system, a light fixing method of performing fixing by irradiating an unfixed toner image formed on a recording medium with light is known, and as a toner used in image formation of the light fixing method, a toner containing an infrared absorbent is known.

SUMMARY

According to an aspect of the invention, there is provided a resin composition, including a resin;

at least one selected from the group consisting of compounds represented by the following formula (I-1); and at least one selected from the group consisting of compounds represented by the following formula (I-2) and compounds represented by the following formula (I-3):

Formula (I-1)

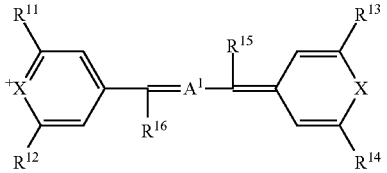

Formula (I-2)

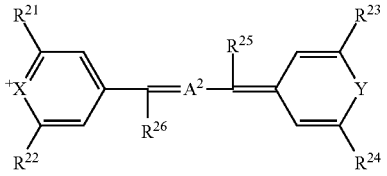

Formula (I-3)

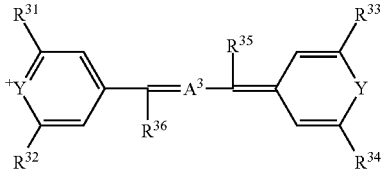

Formula (a1)

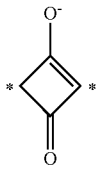

-continued

Formula (a2)

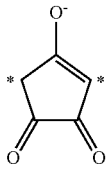

wherein $R^{11}$, $R^{12}$, $R^{13}$, $R^{14}$, $R^{21}$, $R^{22}$, $R^{23}$, $R^{24}$, $R^{31}$, $R^{32}$, $R^{33}$, and $R^{34}$ each independently represent a hydrogen atom, an alkyl group, an alkoxy group, an aryl group, or an aralkyl group, $R^{15}$, $R^{16}$, $R^{25}$, $R^{26}$, $R^{35}$, and $R^{36}$ each independently represent a hydrogen atom or an alkyl group, X represents an oxygen atom, a sulfur atom, a selenium atom, or a tellurium atom, with the proviso that plural X's each represent the same element, Y represents an oxygen atom, a sulfur atom, a selenium atom, or a tellurium atom, with the proviso that plural Y's each represent the same element, which is an element different from the element selected as X, $A^1$, $A^2$, and $A^3$ each independently represent a divalent group represented by formula (a1) or (a2), and the divalent group represented by formula (a1) or (a2) is bonded at the * positions.

BRIEF DESCRIPTION OF THE DRAWINGS

Exemplary embodiments of the present invention will be described in detail based on the following FIGURES, wherein:

The FIGURE is a configuration diagram schematically showing one example of an image forming apparatus according to the exemplary embodiment.

DETAILED DESCRIPTION

Hereinafter, an exemplary embodiment showing an example of the exemplary embodiment of the present invention will be described.

Resin Composition

The resin composition according to the exemplary embodiment includes the following components.

(1) Resin (2) At least one selected from the group consisting of compounds represented by the following formula (I-1)

(3) At least one selected from the group consisting of compounds represented by the following formula (I-2) and compounds represented by the following formula (I-3)

Formula (I-1)

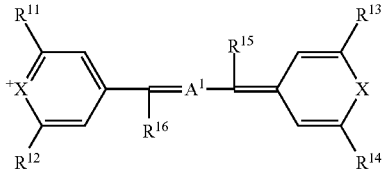

Formula (I-2)

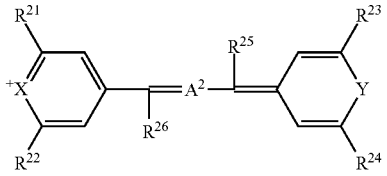

-continued

Formula (I-3)

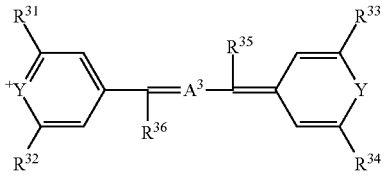

Formula (a1)

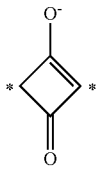

Formula (a2)

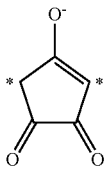

In formulas (I-1), (I-2), and (I-3), $R^{11}$, $R^{12}$, $R^{13}$, $R^{14}$, $R^{21}$, $R^{22}$, $R^{23}$, $R^{24}$, $R^{31}$, $R^{32}$, $R^{33}$, and $R^{34}$ each independently represent a hydrogen atom, an alkyl group, an alkoxy group, an aryl group, or an aralkyl group.

$R^{15}$, $R^{16}$, $R^{25}$, $R^{26}$, $R^{35}$, and $R^{36}$ each independently represent a hydrogen atom or an alkyl group.

X represents an oxygen atom, a sulfur atom, a selenium atom, or a tellurium atom, with the proviso that plural X's each represent the same element.

Y represents an oxygen atom, a sulfur atom, a selenium atom, or a tellurium atom, with the proviso that plural Y's each represent the same element, which is an element different from the element selected as X.

$A^1$, $A^2$, and $A^3$ each independently represent a divalent group represented by formula (a1) or (a2).

The divalent group represented by formula (a1) or (a2) is bonded at the * positions.

There is provided a resin composition in which color turbidity is prevented by having the above configuration according to the resin composition according to the exemplary embodiment.

The reason why such an effect is obtained is not entirely clear, but, it is thought to be as follows.

In the related art, for the purpose of imparting an infrared absorbing performance to a resin composition, a squarylium compound (for example, among compounds represented by the following formula (base), a compound in which A is the group represented by formula (a1)) or a croconium compound (for example, among compounds represented by the following formula (base), a compound in which A is the group represented by formula (a2)) is included in a resin composition in some cases. However, the squarylium compound or the croconium compound has an absorption wavelength in the visible range, and as a result of including these compounds, in the resin composition, coloring and color turbidity occur in some cases. Accordingly, it is demanded to prevent an occurrence of the color turbidity.

Formula (base)

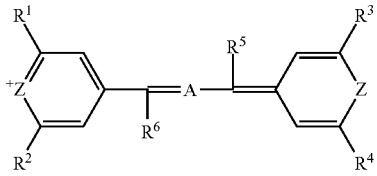

In formula (base), $R^1$ has the same meaning as $R^{11}$, $R^{21}$ and $R^{31}$ in formulas (I-1) to (I-3), and $R^2$ to $R^4$ have the same meaning as $R^{12}$ to $R^{14}$, $R^{22}$ to $R^{24}$, and $R^{32}$ to $R^{34}$ in formulas (I-1) to (I-3), respectively.

$R^5$ and $R^6$ have the same meaning as $R^{15}$ and $R^{16}$, $R^{25}$ and $R^{26}$, and $R^{35}$ and $R^{36}$ in formulas (I-1) to (I-3), respectively.

A has the same meaning as $A^1$ to $A^3$ in formulas (I-1) to (I-3).

Z represents an oxygen atom, a sulfur atom, a selenium atom, or a tellurium atom, and plural Z's may be the same as or different form each other.

In contrast, the resin composition according to the exemplary embodiment is a resin composition containing (2) at least one selected from the group consisting of compounds represented by formula (I-1) and (3) at least one selected from the group consisting of compounds represented by formula (I-2) and compounds represented by formula (I-3). That is, the resin composition is a mixed system including two or more different compounds in which at least one element of the plural Z's in the formula (base) is different.

It is thought that by being a mixed system including two or more different compounds in which at least one of "Z"s in the formula (base) is different, the dispersibility in the resin composition is improved compared to the case of a pure substance system containing only one of the compound represented by the formula (base).

In an aspect of the pure substance system containing only one of the compound represented by the formula (base), the compound is likely to be strongly binded to constitute a crystal, and aggregates are likely to occur. In contrast, in an aspect of a mixed system including two or more different compounds in which at least one of "Z"s in the formula (base) is different, the binding between the compounds is weakened, and thus, it is possible to prevent an occurrence of aggregates, and it is possible to make the size of the formed aggregates smaller. Thus, the dispersibility in the resin composition is improved, and the characteristics such as infrared absorption performance is favorably exhibited, and thus, it is possible to reduce the addition amount of the compound represented by the formula (base). The reduced addition amount appears to causes the depth of color of the resin composition to be decreased and the color turbidity to be prevented.

Hereinafter, the configuration of the resin composition according to the exemplary embodiment will be described.

Specific Squarylium-Croconium Compound

The resin composition according to the exemplary embodiment includes the following components among a compound represented by the following formula (I-1), a compound represented by the following formula (I-2), and a compound represented by the following formula (I-3) (in the present specification, these are collectively referred to as "specific squarylium-croconium compound").

(2) At least one selected from the group consisting of compounds represented by the following formula (I-1)

(3) At least one selected from the group consisting of compounds represented by the following formula (I-2) and compounds represented by the following formula (I-3)

Moreover, in the present specification, a mixture of (2) and (3) is referred to as "a mixture of the specific squarylium-croconium compound".

Formula (I-1)

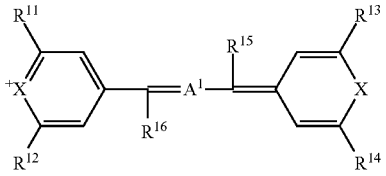

Formula (I-2)

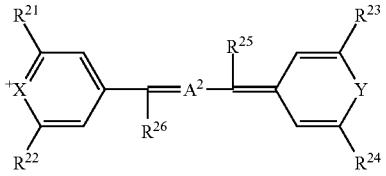

Formula (I-3)

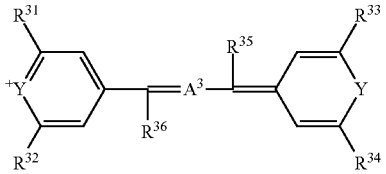

Formula (a1)

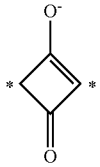

Formula (a2)

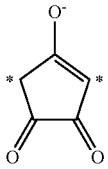

$R^{11}$ to $R^{14}$, $R^{21}$ to $R^{24}$, and $R^{31}$ to $R^{34}$.

In formulas (I-1), (I-2), and (I-3), $R^{11}$ to $R^{14}$, $R^{21}$ to $R^{24}$, and $R^{31}$ to $R^{34}$ each independently represent a hydrogen atom, an alkyl group, an alkoxy group, an aryl group, or an aralkyl group.

Moreover, it is preferable that each of $R^{11}$ to $R^{14}$, $R^{21}$ to $R^{24}$, and $R^{31}$ to $R^{34}$ does not have an unsaturated bond, is preferably an alkyl group or an alkoxy group, and more preferably an alkyl group, from the viewpoint of preventing color turbidity.

As the alkyl group represented by each of $R^{11}$ to $R^{14}$, $R^{21}$ to $R^{24}$, and $R^{31}$ to $R^{34}$, an alkyl group having from 1 to 12 carbon atoms is preferable, an alkyl group having from 1 to 10 carbon atoms is more preferable, an alkyl group having from 3 to 8 carbon atoms is still more preferable, and an alkyl group having from 4 to 6 carbon atoms is still more preferable.

In addition, the alkyl group may have any one of a linear chain shape, a branched chain shape, and a cyclic chain shape.

Examples of the alkyl group include a methyl group, an ethyl group, a n-propyl group, an isopropyl group, a n-butyl group, an isobutyl group, a sec-butyl group, a tert-butyl group, a n-pentyl group, an isopentyl group, a neopentyl group, a tert-pentyl group, a n-hexyl group, an isohexyl group, a sec-hexyl group, a tert-hexyl group, a n-heptyl group, an isoheptyl group, a sec-heptyl group, a tert-heptyl group, a n-octyl group, an isooctyl group, a sec-octyl group, a tert-octyl group, a n-nonyl group, an isononyl group, a sec-nonyl group, a tert-nonyl group, a n-decyl group, an isodecyl group, a sec-decyl group, a tert-decyl group, an n-undecyl group, an isoundecyl group, a n-dodecyl group, and an isododecyl group.

Among these, from the viewpoint of preventing decomposition of the specific squarylium-croconium compound, a branched alkyl group is preferable, and an alkyl group (tertiary (tert) alkyl group) having a structure in which the terminal is branched into three is more preferable. Specifically, an isopropyl group, an isobutyl group, a sec-butyl group, a tert-butyl group, an isopentyl group, a neopentyl group, a tert-pentyl group, an isohexyl group, a sec-hexyl group, a tert-hexyl group, an isoheptyl group, a sec-heptyl group, a tert-heptyl group, an isooctyl group, a sec-octyl group, a tert-octyl group, an isononyl group, a sec-nonyl group, a tert-nonyl group, an isodecyl group, a sec-decyl group, a tert-decyl group, an isoundecyl group, or an isododecyl group is preferable, and a tert-butyl group, a tert-pentyl group, a tert-hexyl group, a tert-heptyl group, a tert-octyl group, a tert-nonyl group, or a tert-decyl group is more preferable. Among these, a tert-butyl group is particularly preferable.

Moreover, the alkyl group may be substituted with a halogen atom (for example, a fluorine atom or a chlorine atom).

Specific examples and the preferable ranges of the alkyl group in the alkoxy group represented by each of $R^{11}$ to $R^{14}$, $R^{21}$ to $R^{24}$, and $R^{31}$ to $R^{34}$ are the same as those of the alkyl group represented by each of $R^{11}$ to $R^{14}$, $R^{21}$ to $R^{24}$, and $R^{31}$ to $R^{34}$.

As the aryl group represented by each of $R^{11}$ to $R^{14}$, $R^{21}$ to $R^{24}$, and $R^{31}$ to $R^{34}$, a group obtained by removing one hydrogen atom from benzene or a benzene ring of an alkyl benzene is preferable, and a group represented by the following structural formula is more preferable.

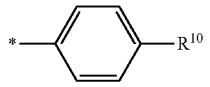

In the above structural formula, * represents a binding site with a central skeleton, and $R^{10}$ represents a hydrogen atom or an alkyl group. As the alkyl group represented by $R^{10}$, an alkyl group having from 2 to 8 carbon atoms is preferable.

Specific examples and the preferable range of the alkyl group represented by $R^{10}$ are the same as those of the alkyl group represented each of $R^{11}$ to $R^{14}$, $R^{21}$ to $R^{24}$, and $R^{31}$ to $R^{34}$ Moreover, the aryl group may be substituted with a halogen atom (for example, a fluorine atom or a chlorine atom).

Specific examples and the preferable ranges of the alkyl group in the aralkyl group represented by each of $R^{11}$ to $R^{14}$, $R^{21}$ to $R^{24}$, and $R^{31}$ to $R^{34}$ are the same as those of the alkyl group represented each of $R^{11}$ to $R^{14}$, $R^{21}$ to $R^{24}$, and $R^{31}$ to $R^{34}$. In addition, specific examples and the preferable range of the aryl group in the aralkyl group are the same as those of the aryl group represented each of $R^{11}$ to $R^{14}$, $R^{21}$ to $R^{24}$, and $R^{31}$ to $R^{34}$.

$R^{15}$ and $R^{16}$, $R^{25}$ and $R^{26}$, and $R^{35}$ to $R^{36}$.

In formulas (I-1), (I-2), and (I-3), $R^{15}$ and $R^{16}$, $R^{25}$ and $R^{26}$, and $R^{35}$ to $R^{36}$ each independently represent a hydrogen atom or an alkyl group.

The alkyl group represented by each of $R^{15}$ and $R^{16}$, $R^{25}$ and $R^{26}$, and $R^{35}$ to $R^{36}$ may have any one of a linear chain shape, a branched chain shape, and a cyclic chain shape. In the case of a linear chain shape or a branched chain shape, the alkyl group preferably has from 1 to 6 carbon atoms (more preferably from 1 to 3 carbon atoms, and still more preferably 1 carbon atom). In addition, in the case of a cyclic chain shape (cycloalkyl group), the cycloalkyl group preferably has from 3 to 6 carbon atoms (more preferably 3 or 4 carbon atoms, and still more preferably 3 carbon atom).

Specific examples thereof include a methyl group, an ethyl group, a n-propyl group, an isopropyl group, a n-butyl group, an isobutyl group, a sec-butyl group, a tert-butyl group, a n-pentyl group, an isopentyl group, a neopentyl group, a tert-pentyl group, a n-hexyl group, an isohexyl group, a sec-hexyl group, a tert-hexyl group, a cyclopropyl group, a cyclobutyl group, a cyclopentyl group, and a cyclohexyl group.

Each of $R^{15}$ and $R^{16}$, $R^{25}$ and $R^{26}$, and $R^{35}$ to $R^{36}$ is preferably a hydrogen atom or a methyl group, and more preferably a hydrogen atom.

X and Y

In formulas (I-1), (I-2), and (I-3), X represents an oxygen atom, a sulfur atom, a selenium atom, or a tellurium atom, with the proviso that the plural X's each represent the same element. Y represents an oxygen atom, a sulfur atom, a selenium atom, or a tellurium atom, and represents a different element from the element selected as X, and the plural Y's each represent the same element.

X is preferably either an oxygen atom or a sulfur atom, and Y is preferably either an oxygen atom or a sulfur atom, which is different from X.

In other words, the resin composition according to the exemplary embodiment preferably includes at least two types of compounds of [ii1], [ii2], and [ii3] described below.

[ii1] At least one selected from the group consisting of compounds represented by formula (II-1)

[ii2] At least one selected from the group consisting of compounds represented by formula (II-2)

[ii3] At least one selected from the group consisting of compounds represented by formula (II-3)

Formula (II-1)

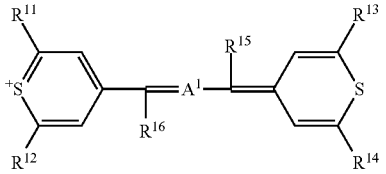

Formula (II-2)

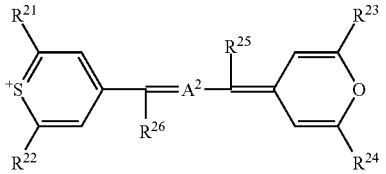

-continued

Formula (II-3)

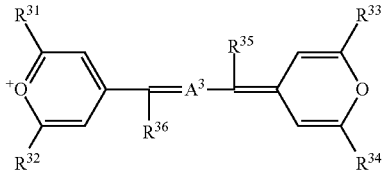

In formulas (II-1), (II-2), and (II-3), each of $R^{11}$, $R^{12}$, $R^{13}$, $R^{14}$, $R^{21}$, $R^{22}$, $R^{23}$, $R^{24}$, $R^{31}$, $R^{32}$, $R^{33}$, $R^{34}$, $R^{15}$, $R^{16}$, $R^{25}$, $R^{26}$, $R^{35}$, $R^{36}$, $A^1$, $A^2$, and $A^3$ has the same meaning as each group in formulas (I-1), (I-2), and (I-3).

$A^1$, $A^2$, and $A^3$

In formula (I-1), (I-2), and (I-3), $A^1$, $A^2$, and $A^3$ each independently represent the divalent group represented by formula (a1) (that is, a squarylium compound) or the divalent group represented by formula (a2) (that is, a croconium compound).

Each of $A^1$, $A^2$, and $A^3$ is preferably the divalent group represented by formula (a1). Namely, in the exemplary embodiment, a squarylium compound is more preferably included.

SPECIFIC EXAMPLES

Here, specific examples of the specific squarylium-croconium compound are shown.

Specific examples of the compound represented by formula (I-1) include the following compounds.

Moreover, with respect to the following compounds, those where X is substituted with Y, $A^1$ is substituted with $A^3$, and $R^{11}$ to $R^{16}$ are substituted with $R^{31}$ to $R^{36}$, respectively are exemplified as specific examples of the compound represented by formula (I-3).

| | X | $A^1$ | $R^{11}$ | $R^{12}$ | $R^{13}$ | $R^{14}$ | $R^{15}$ | $R^{16}$ |
|---|---|---|---|---|---|---|---|---|
| I-1-(1) | (any | (any one | | H | | | | H |
| I-1-(2) | one of | of the | | H | | | | Me |
| I-1-(3) | the | following) | | Me | | | | H |
| I-1-(4) | follow- | formula | | Me | | | | Me |
| I-1-(5) | ing) | (a1) or | | Et | | | | H |
| I-1-(6) | O | formula | | Et | | | | Me |
| I-1-(7) | S | (a2) | | iso-Pr | | | | H |
| I-1-(8) | Se | | | iso-Pr | | | | Me |
| I-1-(9) | Te | | | n-Pr | | | | H |
| I-1-(10) | | | | n-Pr | | | | Me |
| I-1-(11) | | | | tert-Bu | | | | H |
| I-1-(12) | | | | tert-Bu | | | | Me |
| I-1-(13) | | | | iso-Bu | | | | H |
| I-1-(14) | | | | iso-Bu | | | | Me |
| I-1-(15) | | | | n-Bu | | | | H |
| I-1-(16) | | | | n-Bu | | | | Me |
| I-1-(17) | | | | tert-pentyl | | | | H |
| I-1-(18) | | | | tert-pentyl | | | | Me |
| I-1-(19) | | | | sec-pentyl | | | | H |
| I-1-(20) | | | | sec-pentyl | | | | Me |
| I-1-(21) | | | | iso-pentyl | | | | H |
| I-1-(22) | | | | iso-pentyl | | | | Me |
| I-1-(23) | | | | n-pentyl | | | | H |
| I-1-(24) | | | | n-pentyl | | | | Me |
| I-1-(25) | | | | tert-hexyl | | | | H |
| I-1-(26) | | | | tert-hexyl | | | | Me |
| I-1-(27) | | | | sec-hexyl | | | | H |
| I-1-(28) | | | | sec-hexyl | | | | Me |
| I-1-(29) | | | | iso-hexyl | | | | H |
| I-1-(30) | | | | iso-hexyl | | | | Me |
| I-1-(31) | | | | n-hexyl | | | | H |
| I-1-(32) | | | | n-hexyl | | | | Me |
| I-1-(33) | (any | (any | | Methoxy | | | | H |

-continued

| | X | $A^1$ | $R^{11}$ | $R^{12}$ | $R^{13}$ | $R^{14}$ | $R^{15}$ | $R^{16}$ |
|---|---|---|---|---|---|---|---|---|
| I-1-(34) | one of | one of | | Methoxy | | | Me | |
| I-1-(35) | the | the | | Ethoxy | | | H | |
| I-1-(36) | follow- | follow- | | Ethoxy | | | Me | |
| I-1-(37) | ing) | ing) | | Phenyl | | | H | |
| I-1-(38) | O | formula | | Phenyl | | | Me | |
| I-1-(39) | S | (a1) or | | Phenylmethyl | | | H | |
| I-1-(40) | Se | formula | | Phenylmethyl | | | Me | |
| I-1-(41) | Te | (a2) | tert-Bu | | iso-Bu | | H | |
| I-1-(42) | | | tert-Bu | | iso-Bu | | Me | |
| I-1-(43) | | | tert-Bu | | n-Bu | | H | |
| I-1-(44) | | | tert-Bu | | n-Bu | | Me | |
| I-1-(45) | | | iso-Bu | | n-Bu | | H | |
| I-1-(46) | | | iso-Bu | | n-Bu | | Me | |

In the compound represented by formula (I-1) exemplified as described above, X is preferably either an oxygen atom or a sulfur atom.

$A^1$ is preferably the divalent group represented by formula (a1).

Among the specific examples described above, the compound I-1-(11) is preferable.

In addition, specific examples of the compound represented by formula (I-2) include the following compounds.

| | X Y | $A^2$ | $R^{21}$ | $R^{22}$ | $R^{23}$ | $R^{24}$ | $R^{25}$ | $R^{26}$ |
|---|---|---|---|---|---|---|---|---|
| I-2-(1) | (any one | (any | | H | | | H | |
| I-2-(2) | of the | one of | | H | | | Me | |
| I-2-(3) | following) | the | | Me | | | H | |
| I-2-(4) | O, S, Se, | follow- | | Me | | | Me | |
| I-2-(5) | Te (X and | ing) | | Et | | | H | |
| I-2-(6) | Y are | formula | | Et | | | Me | |
| I-2-(7) | different | (a1) or | | iso-Pr | | | H | |
| I-2-(8) | elements) | formula | | iso-Pr | | | Me | |
| I-2-(9) | | (a2) | | n-Pr | | | H | |
| I-2-(10) | | | | n-Pr | | | Me | |
| I-2-(11) | | | | tert-Bu | | | H | |
| I-2-(12) | | | | tert-Bu | | | Me | |
| I-2-(13) | | | | iso-Bu | | | H | |
| I-2-(14) | | | | iso-Bu | | | Me | |
| I-2-(15) | | | | n-Bu | | | H | |
| I-2-(16) | | | | n-Bu | | | Me | |
| I-2-(17) | | | | tert-pentyl | | | H | |
| I-2-(18) | | | | tert-pentyl | | | Me | |
| I-2-(19) | | | | sec-pentyl | | | H | |
| I-2-(20) | | | | sec-pentyl | | | Me | |
| I-2-(21) | | | | iso-pentyl | | | H | |
| I-2-(22) | | | | iso-pentyl | | | Me | |
| I-2-(23) | | | | n-pentyl | | | H | |
| I-2-(24) | | | | n-pentyl | | | Me | |
| I-2-(25) | | | | tert-hexyl | | | H | |
| I-2-(26) | | | | tert-hexyl | | | Me | |
| I-2-(27) | | | | sec-hexyl | | | H | |
| I-2-(28) | | | | sec-hexyl | | | Me | |
| I-2-(29) | | | | iso-hexyl | | | H | |
| I-2-(30) | | | | iso-hexyl | | | Me | |
| I-2-(31) | | | | n-hexyl | | | H | |
| I-2-(32) | | | | n-hexyl | | | Me | |
| I-2-(33) | (any one | (any | | Methoxy | | | H | |
| I-2-(34) | of the | one of | | Methoxy | | | Me | |
| I-2-(35) | following) | the | | Ethoxy | | | H | |
| I-2-(36) | O, S, Se, | follow- | | Ethoxy | | | Me | |
| I-2-(37) | Te (X and | ing) | | Phenyl | | | H | |
| I-2-(38) | Y are | formula | | Phenyl | | | Me | |
| I-2-(39) | different | (a1) or | | Phenylmethyl | | | H | |
| I-2-(40) | elements) | formula | | Phenylmethyl | | | Me | |
| I-2-(41) | | (a2) | tert-Bu | | iso-Bu | | H | |
| I-2-(42) | | | tert-Bu | | iso-Bu | | Me | |
| I-2-(43) | | | tert-Bu | | n-Bu | | H | |
| I-2-(44) | | | tert-Bu | | n-Bu | | Me | |
| I-2-(45) | | | iso-Bu | | n-Bu | | H | |
| I-2-(46) | | | iso-Bu | | n-Bu | | Me | |

In the compound represented by formula (I-2) exemplified as described above, X is preferably either an oxygen atom or a sulfur atom, and Y is preferably either an oxygen atom or a sulfur atom, which is different from X.

$A^2$ is preferably the divalent group represented by formula (a1).

Among the specific examples described above, the compound I-2-(11) is preferable.

Combination in Mixture

The resin composition according to the exemplary embodiment includes a mixture of (2) at least one selected from the group consisting of the compounds represented by formula (I-1) and (3) at least one selected from the group consisting of the compounds represented by formula (I-2) and the compounds represented by formula (I-3), as the specific squarylium-croconium compound.

As the combination in the mixture of the specific squarylium-croconium compound, the following combinations are exemplified.

a) Combination of one or two or more (preferably one type) of the compounds represented by formula (I-1) and one or two or more types (preferably one type) of the compounds represented by formula (I-2)

b) Combination of one or two or more (preferably one type) of the compounds represented by formula (I-1) and one or two or more (preferably one type) of the compounds represented by formula (I-3)

c) Combination of one or two or more (preferably one type) of the compounds represented by formula (I-1), one or two or more (preferably one type) of the compounds represented by formula (I-2), and one or two or more (preferably one type) of the compounds represented by formula (I-3)

Moreover, from the viewpoint of easiness of production, the combination of a) or c) is more preferable.

In the case of a mixture of a), from the viewpoint of easiness of production, the mixture more preferably includes one type for each of the compound represented by formula (I-1) and the compound represented by formula (I-2).

In addition, in the case of including one type for each of the compounds, from the viewpoint of easiness of production and dispersibility in the resin composition, all of $R^{11}$ and $R^{21}$, $R^{12}$ and $R^{22}$, $R^{13}$ and $R^{23}$, $R^{14}$ and $R^{24}$, $R^{15}$ and $R^{25}$, $R^{16}$ and $R^{26}$, and $A^1$ and $A^2$ in formulas (I-1) and (I-2) are preferably the same (that is, structures other than X and Y are the same).

In the case of a mixture of b), from the viewpoint of easiness of production, the mixture more preferably includes one type for each of the compound represented by formula (I-1) and the compound represented by formula (I-3).

In addition, in the case of including one type for each of the compounds, from the viewpoint of easiness of production and dispersibility in the resin composition, all of $R^{11}$ and $R^{31}$, $R^{12}$ and $R^{32}$, $R^{13}$ and $R^{33}$, $R^{14}$ and $R^{34}$, $R^{15}$ and $R^{35}$, $R^{16}$ and $R^{36}$, and $A^1$ and $A^3$ in formulas (I-1) and (I-3) are preferably the same (that is, structures other than X and Y are the same).

In the case of a mixture of c), from the viewpoint of easiness of production, the mixture more preferably includes one type for each of the compound represented by formula (I-1), the compound represented by formula (I-2), and the compound represented by formula (I-3).

In addition, in the case of including one type for each of the compounds, from the viewpoint of easiness of production and dispersibility in the resin composition, all of $R^{11}$, $R^{21}$, and $R^{31}$, $R^{12}$, $R^{22}$, and $R^{32}$, $R^{13}$, $R^{23}$, and $R^{33}$, $R^{14}$, $R^{24}$, and $R^{34}$, $R^{15}$, $R^{25}$, and $R^{35}$, $R^1$, $R^{26}$, and $R^{36}$, and $A^1$, $A^2$, and $A^3$ in formulas (I-1), (I-2), and (I-3) are preferably the same (that is, structures other than X and Y are the same).

Among these, as a mixture of the specific squarylium-croconium compound, the following combinations are preferable.

Mixture 1

A mixture of a compound represented by formula (I-1) in which X is S, $A^1$ is the group represented by formula (a1), each of $R^{11}$ to $R^{14}$ is a tert-butyl group, and each of $R^{15}$ and $R^{16}$ is a hydrogen atom, and a compound represented by formula (I-2) in which X is S, Y is O, $A^2$ is the group represented by formula (a1), each of $R^{21}$ to $R^{24}$ is a tert-butyl group, and each of $R^{25}$ and $R^{26}$ is a hydrogen atom.

Mixture 2

A mixture of a compound represented by formula (I-1) in which X is S, $A^1$ is the group represented by formula (a1), each of $R^{11}$ to $R^{14}$ is a tert-butyl group, and each of $R^{15}$ and $R^{16}$ is a hydrogen atom, a compound represented by formula (I-2) in which X is S, Y is O, $A^2$ is the group represented by formula (a1), each of $R^{21}$ to $R^{24}$ is a tert-butyl group, and each of $R^{25}$ and $R^{26}$ is a hydrogen atom, and a compound represented by formula (I-3) in which Y is O, $A^3$ is the group represented by formula (a1), each of $R^{31}$ to $R^{34}$ is a tert-butyl group, and each of $R^{35}$ and $R^{36}$ is a hydrogen atom.

Mixture 3

A mixture of a compound represented by formula (I-1) in which X is O, $A^1$ is the group represented by formula (a1), each of $R^{11}$ to $R^{14}$ is a tert-butyl group, and each of $R^{15}$ and $R^{16}$ is a hydrogen atom, a compound represented by formula (I-2) in which X is O, Y is S, $A^2$ is the group represented by formula (a1), each of $R^{21}$ to $R^{24}$ is a tert-butyl group, and each of $R^{25}$ and $R^{26}$ is a hydrogen atom, and a compound represented by formula (I-3) in which Y is S, $A^3$ is the group represented by formula (a1), each of $R^{31}$ to $R^{34}$ is a tert-butyl group, and each of $R^{35}$ and $R^{36}$ is a hydrogen atom.

Mixture 4

A mixture of a compound represented by formula (I-1) in which X is O, $A^1$ is the group represented by formula (a1), each of $R^{11}$ to $R^{14}$ is a tert-butyl group, and each of $R^{15}$ and $R^{16}$ is a hydrogen atom, and a compound represented by formula (I-2) in which X is O, Y is S, $A^2$ is the group represented by formula (a1), each of $R^{21}$ to $R^{24}$ is a tert-butyl group, and each of $R^{25}$ and $R^{26}$ is a hydrogen atom.

Compositional Ratio in Mixture

In the exemplary embodiment, in a mixture of a specific squarylium-croconium compound, the compound represented by formula (I-1) or the compound represented by formula (I-2) is preferably included as a main component, and the compound represented by formula (I-1) is preferably included as a main component.

In a mixture of a specific squarylium-croconium compound, the ratio of the main component is preferably greater than 50% by weight, that is, the content of the remainder (a compound which is not a main component of the compound represented by formula (I-1) and the compound represented by formula (I-2), the compound represented by formula (I-3), or the both compounds) is preferably less than 50% by weight.

The compound represented by formula (I-1), the compound represented by formula (I-2), and the compound represented by formula (I-3) may be used alone or in combination of two or more type thereof, and the concept of the main component and the remainder in the case of including two or more types is defined as the total amount of the two or more types.

In addition, one type for each of the compound represented by formula (I-1), the compound represented by formula (I-2), and the compound represented by formula (I-3) is more preferably included.

In a mixture of a specific squarylium-croconium compound, the ratio of the main component is preferably from 85.0% by weight to 99.9% by weight (the remainder is from 0.1% by weight to 15.0% by weight), more preferably from 90% by weight to 99% by weight (the remainder is from 1% by weight to 10% by weight), and still more preferably from 92% by weight to 98% by weight (the remainder is from 2% by weight to 8% by weight).

If the ratio of the main component is 85.0% by weight or greater (the remainder is 15.0% by weight or less), it is easy to control to the range in which characteristics such as infrared absorption performance are required. On the other hand, if the ratio of the main component is 99.9% by weight or less (the remainder is 0.1% by weight or greater), color turbidity is prevented, and infrared absorption performance is enhanced.

In addition, the compositional ratio of each compound included in the mixture of the specific squarylium-croconium compound is measured by using high performance liquid chromatography (HPLC) below.

Measurement by HPLC

In the measurement, a high-performance liquid chromatography apparatus (HPLC apparatus, manufacturer: Shimadzu Corporation, Model No: LC-10A) is used. As the column for HPLC, a column manufactured by Chemco Scientific Co., Ltd. (product name: CHEMCOSORB, part number: 5-ODS-H, inner diameter: 4.6 mm, length: 150 mm) is used. The measurement is performed under conditions of a column temperature of 45° C., an injection volume of a measurement sample of 10 μl, a flow rate of a measurement sample of 1 ml/min, a detection wavelength of 254 nm, and a mobile phase of a mixed solution of acetonitrile and water (acetonitrile:water=9:1).

Synthetic Method of Mixture

Here, the synthetic method of a mixture of the specific squarylium-croconium compound will be described.

First, a mixture of the compound represented by formula (I-1), the compound represented by formula (I-2), and the compound represented by formula (I-3) and a mixture of the compound represented by formula (I-1) and the compound represented by formula (I-2) may be synthesized, for example, by the following method.

Synthetic Method 1

The mixture of the compound represented by formula (I-1), the compound represented by formula (I-2), and the compound represented by formula (I-3) is synthesized, for example, according to the following (Scheme 1), (Scheme 2-1), (Scheme 2-2), and (Scheme 3). Here, in the following schemes, an example in which each of $A^1$, $A^2$, and $A^3$ in formulas (I-1), (I-2), and (I-3) is the group represented by formula (a1), $R^{11}$ to $R^{14}$, $R^{21}$ to $R^{24}$, and $R^{31}$ to $R^{34}$ are the same groups ($R_a$), each of $R^{15}$, $R^{16}$, $R^{25}$, $R^{26}$, $R^{35}$, and $R^{36}$ is a hydrogen atom, X is a sulfur atom, and Y is an oxygen atom is shown.

⟨Scheme 1⟩

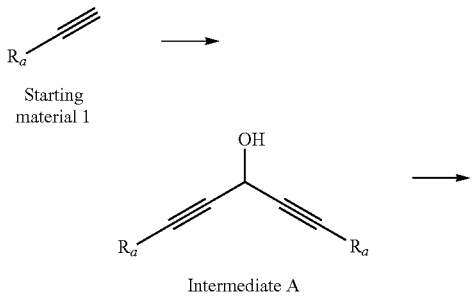

-continued

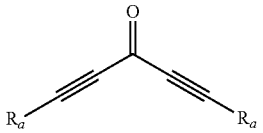

Intermediate B

⟨Scheme 2-1⟩

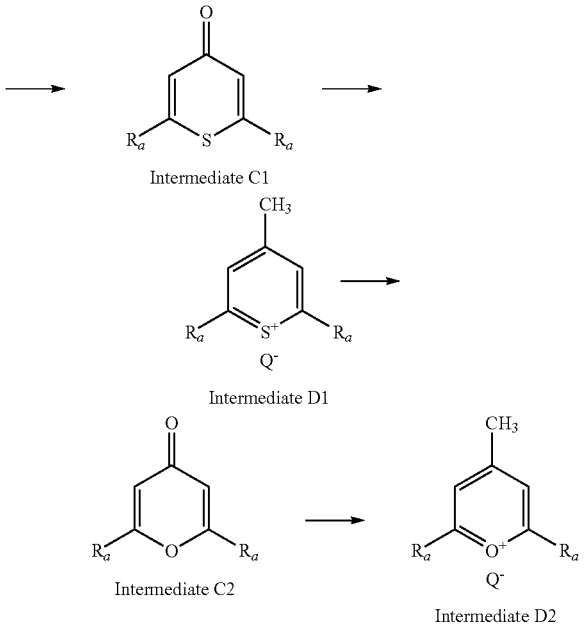

Intermediate C1

Intermediate D1

Intermediate C2

Intermediate D2

⟨Scheme 3⟩

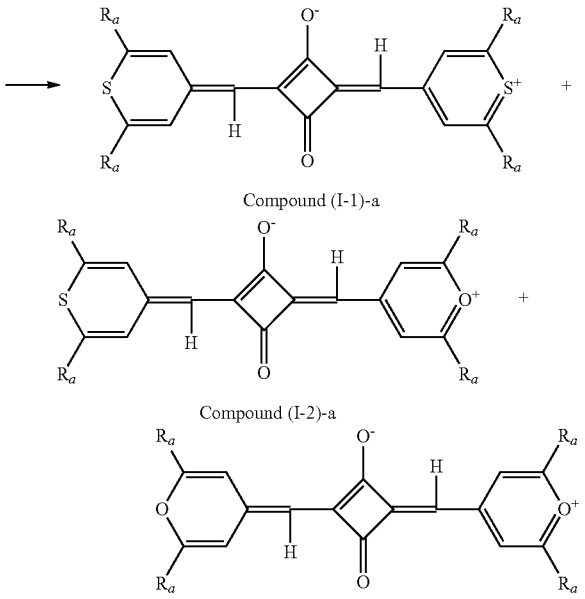

Compound (I-1)-a

Compound (I-2)-a

Compound (I-3)-a

<Scheme 1>

First, in an inert atmosphere and under cooling, the starting material 1 is added dropwise to an organic solvent (for example, tetrahydrofuran) solution of an organomagnesium halide (for example, a Grignard reagent such as ethylmagnesium chloride) to act. Thereafter, to complete the reaction, the temperature may be returned to room temperature (for example, 23° C. to 25° C.) or a higher temperature than room temperature. Next, a formic acid derivative (for example, ethyl formate) is added dropwise thereto to act under cooling. Thereafter, to complete the reaction, the temperature may be returned to room temperature (for example, 23° C. to 25° C.) or a higher temperature than room temperature.

The organic material is extracted from the reaction-finished mixture, whereby an intermediate A is obtained from the separated organic layer.

Next, the intermediate A and an oxidation reagent (for example, manganese oxide) are added to a solvent (for example, cyclohexane), followed by heating to reflux to react. The water generated during the reaction may be removed. An intermediate B is obtained from the organic layer of the reaction mixture. Moreover, purification may be performed when obtaining the intermediate B.

<Scheme 2-1>

Next, the intermediate B is subjected to a cycloaddition reaction. For example, using sodium monohydrogen sulfide n-hydrate, an intermediate in which sulfur is present at the position corresponding to X in formulas (I-1) and (I-2) is obtained.

For example, sodium monohydrogen sulfide n-hydrate is added to a solvent (for example, ethanol), and the intermediate B is added dropwise thereto under cooling. Thereafter, after the resultant is reacted at room temperature (for example, 23° C. to 25° C.), the solvent is removed from the reaction liquid, then, tablet salt is added to be saturated, and the organic phase is collected by liquid-liquid separation, whereby an intermediate C1 is obtained from the organic phase. Moreover, purification may be performed when obtaining the intermediate C1.

Next, in an inert atmosphere, a solvent (for example, anhydrous tetrahydrofuran) and the intermediate C1 are mixed, and a Grignard reagent (for example, methylmagnesiumbromide) is added dropwise thereto. After the dropping ends, the reaction liquid is refluxed with heat, and ammonium bromide is added dropwise thereto under cooling. The separated organic layer is dried and concentrated, whereby an intermediate D1 is obtained.

<Scheme 2-2>

Next, the intermediate B is subjected to a cycloaddition reaction in a separate step from Scheme 2-1. For example, using p-toluene sulfonic acid, an intermediate in which an oxygen atom is present at the position corresponding to Y in formulas (I-2) and (I-3) is obtained.

For example, the intermediate B is dissolved in a solvent (for example, methanol), then, p-toluene sulfonic acid is added thereto, and the resultant is refluxed with heat. After the solvent is removed from the reaction liquid, the resultant is diluted, washed, and concentrated under reduced pressure, and distillation under reduced pressure is performed on the residue, whereby an intermediate C2 is obtained. Moreover, purification may be performed when obtaining the intermediate C2.

Next, in an inert atmosphere, a solvent (for example, anhydrous tetrahydrofuran) and the intermediate C2 are mixed, and a Grignard reagent (for example, methylmagnesium bromide) is added dropwise thereto. After the dropping ends, the reaction liquid is refluxed with heat, and ammonium bromide is added dropwise thereto under cooling. The separated organic layer is dried and concentrated, whereby an intermediate D2 is obtained.

<Scheme 3>

Next, in an inert atmosphere, the intermediate D1, the intermediate D2, and squaric acid are dispersed in a solvent (for example, a mixed solvent of cyclohexane and isobutanol), and a basic compound (for example, pyridine) is added thereto, followed by heating to reflux, whereby a mixture of a compound (I-1)-a, a compound (I-2)-a, and a compound (I-3)-a is obtained. The water generated during the reaction may be removed. In addition, purification, isolation, or concentration may be performed.

Moreover, the ratio of the compound (I-1)-a, the compound (I-2)-a, and the compound (I-3)-a is controlled by adjusting the mixing ratio of the intermediate D1 and the intermediate D2 in Scheme 3.

In addition, to obtain a mixture of the compound (I-1)-a and the compound (I-2)-a, by increasing (for example, 85% by weight or greater) the mixing ratio of the intermediate D1 of the intermediate D1 and the intermediate D2 in Scheme 3 and heating to reflux, a mixture is obtained, and then purification is performed. Thus, the compound (I-3)-a is reduced to less than the detection limit, and a mixture of the compound (I-1)-a and the compound (I-2)-a is obtained.

Synthetic Method 2

Next, the synthesis pathway of a compound in which some or all of $R^{11}$ to $R^{14}$, $R^{21}$ to $R^{24}$, and $R^{31}$ to $R^{34}$ in formulas (I-1), (I-2), and (I-3) are different groups will be described. For example, synthesis of the intermediate A may be performed by changing <Scheme 1> to the following <Scheme 1'>.

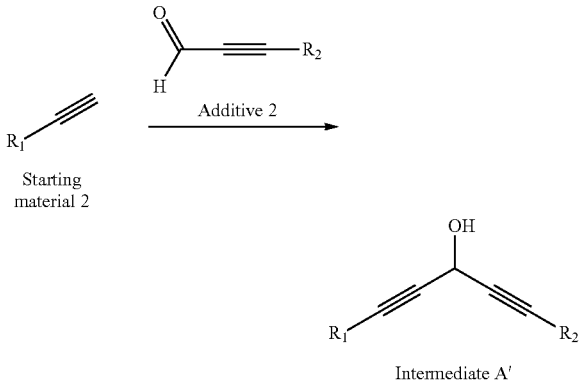

In Scheme 1', first, the starting material 2 and an additive 2 are added to an organic solution (for example, a tetrahydrofuran solution) in which a Grignard reagent (for example, ethylmagnesium bromide) is added to react. A strong acid (for example, hydrochloric acid) is added to the solution after the reaction under cooling, and then, ether is added thereto at room temperature (for example, 23° C. to 25° C.), whereby an intermediate A' is obtained from the organic layer. Moreover, purification may be performed when obtaining the intermediate A'.

Thereafter, by changing the intermediate A in <Scheme 1>, <Scheme 2-1>, <Scheme 2-2>, and <Scheme 3> to the intermediate A', a mixture in which each of $R^{11}$, $R^{13}$, $R^{21}$, $R^{23}$, $R^{31}$, and $R^{33}$ in formulas (I-1), (I-2), and (I-3) is "$R_1$", and each of $R^{12}$, $R^{14}$, $R^{22}$, $R^{24}$, $R^{32}$, and $R^{34}$ is "$R_2$" is obtained.

Synthetic Method 3

In addition, synthesis of a mixture in which $R^{11}$, $R^{12}$, $R^{21}$, $R^{22}$, $R^{31}$, and $R^{32}$ in formulas (I-1), (I-2), and (I-3) are the same groups "$R_b$" and each of $R^{13}$, $R^{14}$, $R^{23}$, $R^{24}$, $R^{33}$, and $R^{34}$ is "$R_c$" will be described. Using a starting material 1' in which $R_a$ in the starting material 1 in <Scheme 1> is substituted with $R_b$, an intermediate B' is synthesized, and in a separate step from this, using a starting material 1" in which $R_a$ in the starting material 1 is substituted with $R_c$, an intermediate B" is synthesized, and by using the intermediate B' and the intermediate B", the above mixture may be synthesized.

Synthetic Method 4

In addition, a mixture of the compound represented by formula (I-1), the compound represented by formula (I-2), and the compound represented by formula (I-3) or a mixture of the compound represented by formula (I-1) and the compound represented by formula (I-2) may be obtained also by a scheme different from Synthetic Method 1.

For example, synthesis may be performed according to the following (Scheme I), (Scheme II), and (Scheme III). Here, in the following schemes, an example in which each of $A^1$, $A^2$, and $A^3$ in formulas (I-1), (I-2), and (I-3) is the group represented by formula (a1), $R^{11}$ to $R^{14}$, $R^{21}$ to $R^{24}$, and $R^{31}$ to $R^{34}$ are the same groups ($R_a$), each of $R^{15}$, $R^{16}$, $R^{25}$, $R^{26}$, $R^{35}$, and $R^{36}$ is a hydrogen atom, X is sulfur, and Y is an oxygen atom is shown.

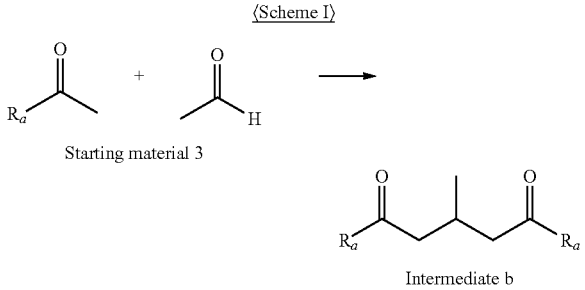

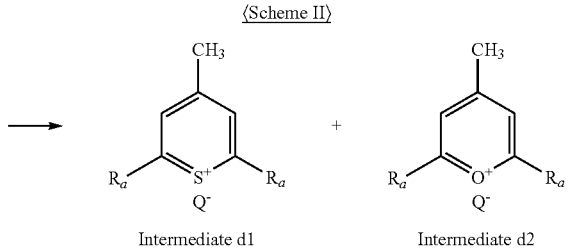

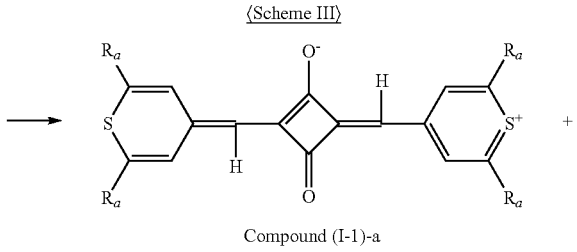

-continued

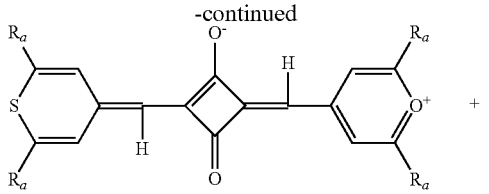

Compound (I-2)-a

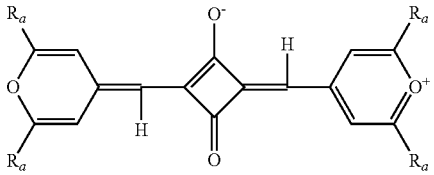

Compound (I-3)-a

Scheme I

The starting material 3 is added to an organic solvent (for example, toluene) to which sodium amide is added, and a toluene solution of acetaldehyde is added dropwise thereto under heating and stirring. After stirring, the resultant is cooled, then, an acidic substance (for example, hydrochloric acid aqueous solution) is added thereto to acidify, and the organic layer is separated, whereby an intermediate b is obtained. Moreover, concentration under reduced pressure or distillation under reduced pressure may be performed when obtaining the intermediate b.

<Scheme II>

Next, the intermediate b is subjected to a cycloaddition reaction. For example, using acetic anhydride ($(CH_3CO)_2O$) and hydrogen sulfide ($H_2S$), an intermediate in which sulfur is present at the position corresponding to X in formulas (I-1), (I-2), and (I-3), and an intermediate in which an oxygen atom is present at the position corresponding to Y are obtained.

For example, acetic anhydride is added to the intermediate b, followed by cooling, and while putting hydrogen sulfide thereinto, and perchloric acid is added dropwise thereto, followed by stirring. After stirring, the precipitated solid is filtered, whereby an intermediate d1 and an intermediate d2 are obtained.

<Scheme III>

Next, the intermediate d1, the intermediate d2, and squaric acid are dispersed in a solvent (for example, a mixed solvent of toluene and isobutanol), and a basic compound (for example, pyridine) is added thereto, followed by heating to reflux, whereby a mixture of the compound (I-1)-a, the compound (I-2)-a, and the compound (I-3)-a is obtained. The water generated during the reaction may be removed. In addition, purification, isolation, or concentration may be performed.

Moreover, the ratio of the compound (I-1)-a, the compound (I-2)-a, and the compound (I-3)-a is controlled by adjusting the introduction amount of hydrogen sulfide ($H_2S$) in Scheme II.

In addition, to obtain a mixture of the compound (I-1)-a and the compound (I-2)-a, by increasing (for example, 85% by weight or greater) the ratio of the intermediate d1 of the intermediate d1 and the intermediate d2 in Scheme II and heating to reflux, a mixture is obtained, and then purification is performed. Thus, the compound (I-3)-a is reduced to less than the detection limit, and a mixture of the compound (I-1)-a and the compound (I-2)-a is obtained.

Other Synthetic Methods

In addition, by separately synthesizing the compound represented by formula (I-1), the compound represented by formula (I-2), and the compound represented by formula (I-3) and mixing these compounds, a mixture of the specific squarylium-croconium compound in the exemplary embodiment may be obtained.

Moreover, according to this method, a mixture which includes the compound represented by formula (I-1) and the compound represented by formula (I-3) and does not include the compound represented by formula (I-2) may also be prepared.

Physical Properties of Mixture

The maximum absorption wavelength of a solution of the mixture of the specific squarylium-croconium compound in tetrahydrofuran (THF) may be within a range from 760 nm to 1,200 nm, preferably within a range from 780 nm to 1,100 nm, and more preferably within a range from 800 nm to 1,000 nm.

The molar absorption coefficient at the maximum absorption wavelength of a solution of the mixture of the specific squarylium-croconium compound in tetrahydrofuran (THF) may be from 100,000 $Lmol^{-1}cm^{-1}$ to 600,000 $Lmol^{-1}cm^{-1}$, preferably from 200,000 $Lmol^{-1}cm^{-1}$ to 600,000 $Lmol^{-1}cm^{-1}$, and more preferably from 250,000 $Lmol^{-1}cm^{-1}$ to 600,000 $Lmol^{-1}cm^{-1}$.

All of the compound represented by formula (I-1), the compound represented by formula (I-2), and the compound represented by formula (I-3) may be present in a solid dispersion state in the resin composition. In the case of being present in the resin composition in a solid dispersion state, the weight average particle diameter thereof may be from 10 nm to 1,000 nm, preferably from 10 nm to 500 nm, and more preferably from 20 nm to 300 nm.

Moreover, the compound represented by formula (I-1), the compound represented by formula (I-2), and the compound represented by formula (I-3) may be present in the resin composition in a molecule dispersion state in which the molecules are dispersed at a molecular level.

Other Infrared Absorbents

The resin composition according to the exemplary embodiment may further include a known infrared absorbent, in addition to a mixture of the specific squarylium-croconium compounds. For example, in a case where the resin composition is used as an electrostatic charge image developing toner, a known infrared absorbent may be used in combination within a range in which the fixability is not affected.

The known infrared absorbent may be obtained by using a cyanine compound, a merocyanine compound, a benzenethiol metal complex, a mercaptophenol metal complex, an aromatic diamine metal complex, a diimonium compound, an aminium compound, a nickel complex compound, a phthalocyanine compound, an anthraquinone compound, or a naphthalocyanine compound.

Specific examples of the known infrared absorbents include nickel metal complex infrared absorbents (SIR-130 and SIR-132, manufactured by Mitsui Chemicals, Inc.), bis(dithiobenzyl)nickel (MIR-101, manufactured by Midori Kagaku Co., Ltd.), bis[1,2-bis(p-methoxyphenyl)-1,2-ethylenedithiolate]nickel (MIR-102, manufactured by Midori Kagaku Co., Ltd.), tetra-n-butylammonium bis(cis-1,2-diphenyl-1,2-ethylenedithiolate)nickel (MIR-1011, manufactured by Midori Kagaku Co., Ltd.), tetra-n-butylammonium bis[1,2-bis(p-methoxyphenyl)-1,2-ethylenedithiolate]nickel (MIR-1021, manufactured by Midori Kagaku Co., Ltd.), bis(4-tert-1,2-butyl-1,2-dithiophenolate)nickel-tetra-n-butylammonium (BBDT-NI, manufactured by Sumitomo Seika Chemicals Co., Ltd.), cyanine infrared absorbents (IRF-106 and IRF-107, manufactured by FUJIFILM (registered trademark)), a cyanine infrared absorbent (YKR2900, manufactured by Yamamoto Chemicals Inc.), aminium and diimonium infrared absorbent (NIR-AM1 and IM1, manufactured by Nagase ChemteX Corporation), imonium compounds (CIR-1080 and CIR-1081, manufactured by Japan CarlitCo., Ltd.), aminium compounds (CIR-960 and CIR-961, manufactured by Japan Carlit Co., Ltd), an anthraquinone compound (IR-750, manufactured by Nippon Kayaku Co., Ltd.), an aminium compound (IRG-002, IRG-003, and IRG-003K, manufactured by Nippon Kayaku Co., Ltd.), a polymethine compound (IR-820B, manufactured by Nippon Kayaku Co., Ltd.), diimonium compounds (IRG-022 and IRG-023, manufactured by Nippon Kayaku Co., Ltd.), dianine compounds (CY-2, CY-4, and CY-9, manufactured by Nippon Kayaku Co., Ltd.), a soluble phthalocyanine (TX-305A, manufactured by Nippon Shokubai Co., Ltd.), naphthalocyanine (YKR5010, manufactured by Yamamoto Chemicals Inc. and Sample 1 manufactured by Sanyo Color Works, LTD.), and inorganic materials (Ytterbium UU-HP, manufactured by Shin-Etsu Chemical Co., Ltd. and indium tin oxide, manufactured by Sumitomo Metal Industries, Ltd.).

Among these, a diimonium compound is preferable.

Resin

The resin composition according to the exemplary embodiment further includes a resin (binder resin).

Binder Resin

Examples of the binder resin include vinyl resins, for example, homopolymers of monomers such as styrenes (for example, styrene, parachlorostyrene, and α-methyl styrene), (meth)acrylic acid esters (for example, methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate), ethylenically unsaturated nitriles (for example, acrylonitrile and methacrylonitrile), vinyl ethers (for example, vinyl methyl ether and vinyl isobutyl ether), vinyl ketones (vinyl methyl ketone, vinyl ethyl ketone, and vinyl isopropenyl ketone), and olefins (for example, ethylene, propylene and butadiene), or copolymers obtained by combining two or more types of these monomers.

Examples of the binder resin include non-vinyl resins such as an epoxy resin, a polyester resin, a polyurethane resin, a polyamide resin, a cellulose resin, a polyether resin, and modified rosin, mixtures of these and the above-described vinyl resins, or graft polymers obtained by polymerizing vinyl monomers in the coexistence of these.

These binder resins may be used alone or in combination of two or more types thereof.

As the binder resin, a polyester resin is suitable.

As the polyester resin, a known polyester resin is exemplified.

Examples of the polyester resin include polycondensates of polyvalent carboxylic acids and polyols. A commercially available product or a synthesized product may be used as the polyester resin.

Examples of the polyvalent carboxylic acid include aliphatic dicarboxylic acids (for example, oxalic acid, malonic acid, maleic acid, fumaric acid, citraconic acid, itaconic acid, glutaconic acid, succinic acid, alkenyl succinic acid, adipic acid, and sebacic acid), alicyclic dicarboxylic acids (for example, cyclohexanedicarboxylic acid), aromatic dicarboxylic acids (for example, terephthalic acid, isophthalic acid, phthalic acid, and naphthalenedicarboxylic acid), anhydrides thereof, or lower alkyl esters (having, for example, from 1 to 5 carbon atoms) thereof. Among these, as the polycarboxylic acid, for example, aromatic dicarboxylic acids are preferable.

As the polyvalent carboxylic acid, a tri- or higher-valent carboxylic acid employing a crosslinked structure or a branched structure may be used in combination together with a dicarboxylic acid. Examples of the tri- or higher-valent carboxylic acid include trimellitic acid, pyromellitic acid, anhydrides thereof, or lower alkyl esters (having, for example, from 1 to 5 carbon atoms) thereof.

The polyvalent carboxylic acids may be used alone or in combination of two or more kinds thereof.

Examples of the polyol include aliphatic diols (for example, ethylene glycol, diethylene glycol, triethylene glycol, propylene glycol, butanediol, hexanediol, and neopentyl glycol), alicyclic diols (for example, cyclohexanediol, cyclohexanedimethanol, and hydrogenated bisphenol A), and aromatic diols (for example, ethylene oxide adduct of bisphenol A and propylene oxide adduct of bisphenol A). Among these, as the polyol, for example, aromatic diols or alicyclic diols are preferable, and aromatic diols are more preferable.

As the polyol, a tri- or higher-valent polyol having a crosslinked structure or a branched structure may be used in combination together with a diol. Examples of the tri- or higher-valent polyol include glycerin, trimethylolpropane, and pentaerythritol.

The polyols may be used alone or in combination of two or more kinds thereof.

The glass transition temperature (Tg) of the polyester resin is preferably from 50° C. to 80° C., and more preferably from 50° C. to 65° C.

The glass transition temperature is determined by a DSC curve obtained by differential scanning calorimetry (DSC). More specifically, the glass transition temperature is determined by "extrapolation glass transition starting temperature" disclosed in a method of determining the glass transition temperature of JIS K 7121-1987 "Testing Methods for Transition Temperature of Plastics".

The weight average molecular weight (Mw) of the polyester resin is preferably from 5,000 to 1,000,000, and more preferably from 7,000 to 500,000.

The number average molecular weight (Mn) of the polyester resin is preferably from 2,000 to 100,000.

The molecular weight distribution Mw/Mn of the polyester resin is preferably from 1.5 to 100, and more preferably from 2 to 60.

Moreover, the weight average molecular weight and the number average molecular weight are measured by Gel Permeation Chromatography (GPC). The molecular weight measurement by GPC is performed with a THF solvent using GPC•HLC-8120 GPC manufactured by Tosoh Corporation as a measurement device and column TSKgel Super HM-M (15 cm) manufactured by Tosoh Corporation. The weight average molecular weight and the number average molecular weight are calculated using a molecular weight calibration curve obtained by monodisperse polystyrene standard samples from the measurement results.

The polyester resin is obtained by a known preparation method. Specific examples thereof include a method of conducting a reaction at a polymerization temperature set to from 180° C. to 230° C., if necessary, under reduced pressure in the reaction system, while removing water or alcohol generated during condensation.

In a case where monomers of the raw materials are not dissolved or compatibilized at a reaction temperature, a high boiling point solvent may be added as a solubilizing agent to dissolve the monomers. In this case, a polycondensation reaction is performed while distilling off the solubilizing agent. In a case where a monomer having poor compatibility is present in a copolymerization reaction, the monomer having poor compatibility and an acid or an alcohol to be polycondensed with the monomer may be previously condensed and then polycondensed with the major component.

Electrostatic Charge Image Developing Toner

Next, the electrostatic charge image developing toner according to the exemplary embodiment will be described.

The electrostatic charge image developing toner according to the exemplary embodiment (hereinafter, also simply referred to as "toner") includes the above-described resin composition according to the exemplary embodiment. The toner according to the exemplary embodiment is configured to include toner particles, and as necessary, an external additive, but the resin composition according to the exemplary embodiment is preferably contained in the toner particles.

The content of the mixture of specific squarylium-croconium compounds described above (that is, a mixture of at least one selected from the group consisting of compounds represented by formula (I-1) and at least one selected from the group consisting of compounds represented by formula (I-2) and compounds represented by formula (I-3)) in the toner particles is preferably from 0.01% by weight to 5% by weight, more preferably from 0.01% by weight to 1% by weight, and still more preferably from 0.01% by weight to 0.5% by weight, with respect to the total weight of the toner particles.

The content of the binder resin in the toner particles is, for example, preferably from 40% by weight to 95% by weight, more preferably from 50% by weight to 90% by weight, and still more preferably from 60% by weight to 85% by weight, with respect to the total toner particles.

Toner Particles

The toner particles may be configured to include, for example, a colorant, a release agent, or other additives, in addition to the resin composition according to the exemplary embodiment.

Colorant

Examples of the colorant include various pigments such as carbon black, chrome yellow, hansa yellow, benzidine yellow, threne yellow, quinoline yellow, pigment yellow, permanent orange GTR, pyrazolone orange, vulcan orange, watchung red, permanent red, brilliant carmine 3B, brilliant carmine 6B, DuPont oil red, pyrazolone red, lithol red, rhodamine B lake, lake red C, pigment red, rose bengal, aniline blue, ultramarine blue, calco oil blue, methylene blue chloride, phthalocyanine blue, pigment blue, phthalocyanine green, and malachite green oxalate, and various dyes such as an acridine dye, a xanthene dye, an azo dye, a benzoquinone dye, an azine dye, an anthraquinone dye, a thioindigo dye, a dioxazine dye, a thiazine dye, an azomethine dye, an indigo dye, a phthalocyanine dye, an aniline black dye, a polymethine dye, a triphenylmethane dye, a diphenylmethane dye, and a thiazole dye.

The colorants may be used alone or two or more types may be used in combination.

As the colorant, a surface-treated colorant may be used as necessary, or the colorant may be used in combination with a dispersant. In addition, plural types of colorants may be used in combination.

The content of the colorant, for example, is preferably from 1% by weight to 30% by weight and more preferably from 3% by weight to 15% by weight with respect to the total toner particles.

Release Agent

Examples of the release agent include hydrocarbon waxes; natural waxes such as a carnauba wax, a rice wax, and a candelilla wax; synthetic or mineral-petroleum waxes such as a montan wax; ester waxes such as fatty acid ester and montanic acid ester; and the like. However, the release agent is not limited thereto.

The melting temperature of the release agent is preferably from 50° C. to 110° C., and more preferably from 60° C. to 100° C.

Moreover, the melting temperature is obtained from "melting peak temperature" described in the method for determining a melting temperature in JIS K 7121-1987 "Testing Methods for Transition Temperatures of Plastics", from a DSC curve obtained by differential scanning calorimetry (DSC).

The content of the release agent, for example, is preferably from 1% by weight to 20% by weight, and more preferably from 5% by weight to 15% by weight with respect to the total toner particles.

Other Additives

As other additives, known additives such as a magnetic material, an charge-controlling agent, and inorganic powder are exemplified. These additives are included in the toner particles as an internal additive.

Characteristics of Toner Particles

The toner particles may be toner particles having a single-layer structure, or toner particles having a so-called core/shell structure configured of a core (core particle) and a coating layer (shell layer) with which the core is coated.

Here, the toner particles having the core/shell structure may be configured to have a core configured to include a binder resin, a mixture of specific squarylium-croconium compounds, and as necessary, other additives such as a colorant and a release agent, and a coating layer configured to include a binder resin.

The volume average particle diameter (D50v) of the toner particles is preferably from 2 μm to 10 μm, and more preferably from 4 μm to 8 μm.

Moreover, various average particle diameters and various particle size distribution indexes of the toner particles are measured using a COULTER MULTISIZER II (manufactured by Beckman Coulter, Inc.), and ISOTON-II (manufactured by Beckman Coulter, Inc.) as an electrolyte.

In the measurement, from 0.5 mg to 50 mg of a measurement sample is added to 2 ml of a 5% aqueous solution of a surfactant (preferably, sodium alkylbenzene sulfonate) as a dispersant. The resultant is added to from 100 ml to 150 ml of the electrolyte.

The electrolyte in which the sample is suspended is subjected to a dispersion treatment using an ultrasonic disperser for 1 minute, and a particle size distribution of particles having a particle diameter of from 2 μm to 60 μm is measured by a COULTER MULTISIZER II using an aperture having an aperture diameter of 100 μm. Moreover, 50,000 particles are sampled.

Cumulative distributions by volume and by number are drawn from the side of the smallest diameter with respect to particle size ranges (channels) separated based on the measured particle size distribution. The particle diameter when the cumulative percentage becomes 16% is defined as that corresponding to a volume particle diameter D16v and a number particle diameter D16p, while the particle diameter when the cumulative percentage becomes 50% is defined as that corresponding to a volume average particle diameter D50v and a cumulative number average particle diameter D50p. Furthermore, the particle diameter when the cumulative percentage becomes 84% is defined as that corresponding to a volume particle diameter D84v and a number particle diameter D84p.

Using these, a volume particle size distribution index (GSDv) is calculated as $(D84v/D16v)^{1/2}$, while a number particle size distribution index (GSDp) is calculated as $(D84p/D16p)^{1/2}$.

The shape factor SF1 of the toner particles is preferably from 110 to 150, and more preferably from 120 to 140.

Moreover, the shape factor SF1 is determined by the following equation.

$$SF1=(ML^2/A)\times(\pi/4)\times 100 \quad \text{Equation:}$$

In the foregoing expression, ML represents an absolute maximum length of a toner particle, and A represents a projected area of a toner particle.

Specifically, the shape factor SF1 is numerically converted mainly by analyzing a microscopic image or a scanning electron microscopic (SEM) image by the use of an image analyzer, and is calculated as follows. That is, an optical microscopic image of particles scattered on a surface of a glass slide is input to an image analyzer Luzex through a video camera to obtain maximum lengths and projected areas of 100 particles, values of SF1 are calculated by the above equation, and an average value thereof is obtained.

External Additive

Examples of the external additive include inorganic particles. Examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)n$, $Al_2O_3.2SiO_2$, $CaCO_3$, $MgCO_3$, $BaSO_4$, and $MgSO_4$.

The surfaces of the inorganic particles as an external additive are preferably subjected to a hydrophobizing treatment. The hydrophobizing treatment is performed by, for example, dipping the inorganic particles in a hydrophobizing agent. The hydrophobizing agent is not particularly limited, and examples thereof include a silane coupling agent, silicone oil, a titanate coupling agent, and an aluminum coupling agent. These may be used alone or in combination of two or more types thereof.

Typically, the amount of the hydrophobizing agent is, for example, from 1 part by weight to 10 parts by weight with respect to 100 parts by weight of the inorganic particles.

Examples of the external additive also include resin particles (resin particles such as polystyrene particles, polymethyl methacrylate (PMMA) particles, or melamine resin particles) and a cleaning aid (for example, a metal salt of higher fatty acid represented by zinc stearate or particles of a fluorine high molecular weight material).

The amount of external additive externally added is, for example, preferably from 0.01% by weight to 5% by weight, and more preferably from 0.01% by weight to 2.0% by weight, with respect to the toner particles.

Method of Preparing Toner

Next, a method of preparing the toner according to the exemplary embodiment will be described.

The toner according to the exemplary embodiment is obtained by externally adding an external additive to toner particles after production of the toner particles.

The toner particles may be produced using any of a dry preparing method (for example, a kneading and pulverizing method) and a wet preparing method (for example, an aggregation and coalescence method, a suspension and polymerization method, and a dissolution and suspension method). The preparing method of toner particles is not particularly limited to these preparing methods, and a known preparing method is employed.

Among these, toner particles may be obtained by the aggregation and coalescence method.

Specifically, for example, in a case where the toner particles are prepared by the aggregation and coalescence method, the toner particles are produced through the processes of: preparing a resin particle dispersion in which resin particles as a binder resin are dispersed (resin particle dispersion preparation process); aggregating the resin particles (as necessary, other particles) in the resin particle dispersion (as necessary, in the dispersion after mixing with the other particle dispersions) to form aggregated particles (aggregated particle forming process); and forming toner particles by heating the aggregated particle dispersion in which the aggregated particles are dispersed to coalesce the aggregated particles (coalescence process).

In the exemplary embodiment, a dispersion obtained by dispersing at least a mixture of specific squarylium-croconium compounds is used as the other particle dispersion described above.

Hereinafter, each process will be described in detail.

Moreover, in the following description, a method of obtaining toner particles including a colorant and a release agent will be described, but the colorant and the release agent are those to be used optionally. Furthermore, other additives other than the colorant and the release agent may also be used.

Resin Particle Dispersion Preparation Step

First, for example, a colorant particle dispersion in which colorant particles are dispersed, and a release agent particle dispersion in which release agent particles are dispersed, together with a resin particle dispersion in which resin particles as a binder resin are dispersed, and a specific squarylium-croconium compound dispersion in which a mixture of the specific squarylium-croconium compound is dispersed, are prepared.

Here, the resin particle dispersion is prepared by, for example, dispersing resin particles in a dispersion medium by a surfactant.

Examples of the dispersion medium used for the resin particle dispersion include aqueous mediums.

Examples of the aqueous mediums include water such as distilled water and ion exchange water, and alcohols. These may be used alone or in combination of two or more types thereof.

Examples of the surfactant include anionic surfactants such as sulfuric ester salt, sulfonate, phosphate ester, and soap anionic surfactants; cationic surfactants such as amine salt and quaternary ammonium salt cationic surfactants; and nonionic surfactants such as polyethylene glycol, alkyl phenol ethylene oxide adduct, and polyol. Among these, anionic surfactants or cationic surfactants are particularly preferable. The nonionic surfactant may be used in combination with an anionic surfactant or a cationic surfactant.

The surfactants may be used alone or in combination of two or more types thereof.

Regarding the resin particle dispersion, as a method for dispersing the resin particles in the dispersion medium, a common dispersing method using, for example, a rotary shearing-type homogenizer, or a ball mill, a sand mill, or a Dyno mill having media is exemplified. In addition, depending on the type of the resin particles, resin particles may be dispersed in the resin particle dispersion using, for example, a phase inversion emulsification method.

The phase inversion emulsification method includes: dissolving a resin to be dispersed in a hydrophobic organic solvent in which the resin is soluble; conducting neutralization by adding a base to an organic continuous phase (Ophase); and converting the resin (so-called phase inversion) from W/O to O/W by putting an aqueous medium (W phase) to form a discontinuous phase, thereby dispersing the resin as particles in the aqueous medium.

The volume average particle diameter of the resin particles dispersed in the resin particle dispersion is, for example, preferably from 0.01 μm to 1 μm, more preferably from 0.08 μm to 0.8 μm, and still more preferably from 0.1 μm to 0.6 μm.

Moreover, regarding the volume average particle diameter of the resin particles, a cumulative distribution by volume is drawn from the side of the smallest diameter with respect to particle size ranges (channels) separated using the particle size distribution obtained by the measurement of a laser diffraction-type particle size distribution measuring apparatus (for example, LA-700, manufactured by Horiba, Ltd.), and a particle diameter when the cumulative percentage becomes 50% with respect to the entirety of the particles is measured as a volume average particle diameter D50v. Moreover, the volume average particle diameter of the particles in other dispersions is also measured in the same manner.

The content of the resin particles included in the resin particle dispersion is, for example, preferably from 5% by weight to 50% by weight, and more preferably from 10% by weight to 40% by weight.

Moreover, in the same manner as the resin particle dispersion, a specific squarylium-croconium compound dispersion in which a mixture of the specific squarylium-croconium compound is dispersed, a colorant particle dispersion, and a release agent particle dispersion are prepared. That is, the particles in the resin particle dispersion are the same as the mixture of the specific squarylium-croconium compound dispersed in a specific squarylium-croconium compound dispersion, the colorant particles dispersed in the colorant particle dispersion, and the release agent particles dispersed in the release agent particle dispersion, in terms of the volume average particle diameter, the dispersion medium, the dispersing method, and the content of the particles.

Aggregated Particle Forming Process

Next, the specific squarylium-croconium compound dispersion, the colorant particle dispersion, and the release agent particle dispersion are mixed together with the resin particle dispersion.

The resin particles, the specific squarylium-croconium compound, the colorant particles, and the release agent particles are heterogeneously aggregated in the mixed dispersion, thereby forming aggregated particles having a diameter near a target toner particle diameter and including the resin particles, the specific squarylium-croconium compound, the colorant particles, and the release agent particles.

Specifically, for example, an aggregating agent is added to the mixed dispersion and a pH of the mixed dispersion is adjusted to acidity (for example, the pH is from 2 to 5). If necessary, a dispersion stabilizer is added. Then, the mixed dispersion is heated at a temperature of the glass transition temperature of the resin particles (specifically, for example, from a temperature 30° C. lower than the glass transition temperature of the resin particles to a temperature 10° C. lower than the glass transition temperature) to aggregate the particles dispersed in the mixed dispersion, thereby forming the aggregated particles.

In the aggregated particle forming process, for example, the aggregating agent may be added at room temperature (for example, 25° C.) under stirring of the mixed dispersion using a rotary shearing-type homogenizer, the pH of the mixed dispersion may be adjusted to acidity (for example, the pH is from 2 to 5), a dispersion stabilizer may be added if necessary, and the heating may then be performed.

Examples of the aggregating agent include a surfactant having an opposite polarity to the polarity of the surfactant used as the dispersing agent to be added to the mixed dispersion, inorganic metal salts and di- or higher valent metal complexes. Particularly, in a case where a metal complex is used as the aggregating agent, the amount of the surfactant used is reduced and charging characteristics are improved.

If necessary, an additive may be used to form a complex or a similar bond with the metal ions of the aggregating agent. A chelating agent is preferably used as the additive.

Examples of the inorganic metal salts include metal salts such as calcium chloride, calcium nitrate, barium chloride, magnesium chloride, zinc chloride, aluminum chloride, and aluminum sulfate, and inorganic metal salt polymers such as polyaluminum chloride, polyaluminum hydroxide, and calcium polysulfide.

A water-soluble chelating agent may be used as the chelating agent. Examples of the chelating agent include oxycarboxylic acids such as tartaric acid, citric acid, and gluconic acid, iminodiacetic acid (IDA), nitrilotriacetic acid (NTA), and ethylenediaminetetraacetic acid (EDTA).

The amount of the chelating agent added is, for example, preferably from 0.01 parts by weight to 5.0 parts by weight, and more preferably from 0.1 parts by weight to 3.0 parts by weight with respect to 100 parts by weight of the resin particles.

Coalescing Step

Next, the aggregated particle dispersion in which the aggregated particles are dispersed is heated at, for example, a temperature that is equal to or higher than the glass transition temperature of the resin particles (for example, equal to or higher than a temperature that is 10° C. to 30° C. higher than the glass transition temperature of the resin particles) to coalesce the aggregated particles and form toner particles.

Toner particles are obtained through the above processes.

After the aggregated particle dispersion in which the aggregated particles are dispersed is obtained, toner particles may be produced through the processes of: further mixing the resin particle dispersion in which the resin particles are dispersed with the aggregated particle dispersion to conduct aggregation so that the resin particles further attach to the surfaces of the aggregated particles, thereby forming second aggregated particles; and coalescing the second aggregated particles by heating the second aggregated particle dispersion in which the second aggregated particles are dispersed, thereby forming toner particles having a core/shell structure.

After the coalescence process ends, the toner particles formed in the solution are subjected to a washing process, a solid-liquid separation process, and a drying process, that are well known, and thus dry toner particles are obtained.

In the washing process, displacement washing using ion exchange water may be sufficiently performed from the viewpoint of charging properties. In addition, the solid-liquid separation process is not particularly limited, but suction filtration, pressure filtration, or the like may be performed from the viewpoint of productivity. The method of the drying process is also not particularly limited, but freeze drying, flash jet drying, fluidized drying, vibration-type fluidized drying, or the like may be performed from the viewpoint of productivity.

The toner according to the exemplary embodiment is produced by, for example, adding an external additive and mixing with dry toner particles that are obtained. The mixing may be performed using, for example, a V-blender, a HENSCHEL mixer, a LODIGE mixer, or the like. Furthermore, as necessary, coarse toner particles may be removed using a vibration classifier, a wind classifier, or the like.

Electrostatic Charge Image Developer

The electrostatic charge image developer according to the exemplary embodiment includes at least the toner according to the exemplary embodiment.

The electrostatic charge image developer according to the exemplary embodiment may be a single-component developer including only the toner according to the exemplary embodiment, or a two-component developer obtained by mixing the toner with a carrier.

The carrier is not particularly limited, and known carriers are exemplified. Examples of the carrier include a coating carrier in which surfaces of cores formed of magnetic particles are coated with a coating resin; a magnetic particle dispersion-type carrier in which magnetic particles is dispersed and blended in a matrix resin; and a resin impregnation-type carrier in which porous magnetic particles are impregnated with a resin.

Moreover, the magnetic particle dispersion-type carrier and the resin impregnation-type carrier may be carriers in which constituent particles of the carrier are cores and have a surface coated with a coating resin.

Examples of the magnetic particles include magnetic metals such as iron, nickel, and cobalt, and magnetic oxides such as ferrite and magnetite.

Examples of the coating resin and the matrix resin include polyethylene, polypropylene, polystyrene, polyvinyl acetate, polyvinyl alcohol, polyvinyl butyral, polyvinyl chloride, polyvinyl ether, polyvinyl ketone, a vinyl chloride-vinyl acetate copolymer, a styrene-acrylic acid copolymer, a straight silicone resin configured to include an organosiloxane bond or a modified product thereof, a fluororesin, polyester, polycarbonate, a phenol resin, and an epoxy resin.

Moreover, the coating resin and the matrix resin may include other additives such as a conductive particle.

Examples of the conductive particles include particles of metals such as gold, silver, and copper, carbon black particles, titanium oxide particles, zinc oxide particles, tin oxide particles, barium sulfate particles, aluminum borate particles, and potassium titanate particles.

Here, a coating method using a coating layer forming solution in which a coating resin and, as necessary, various additives are dissolved in an appropriate solvent is used to coat the surface of a core with the coating resin. The solvent is not particularly limited, and may be selected in consideration of the type of coating resin to be used, coating suitability, and the like.

Specific examples of the resin coating method include a dipping method of dipping cores in a coating layer forming solution; a spraying method of spraying a coating layer forming solution to surfaces of cores; a fluid bed method of spraying a coating layer forming solution in a state in which cores are allowed to float by flowing air; and a kneader-coater method in which cores of a carrier and a coating layer forming solution are mixed with each other in a kneader-coater and the solvent is removed.

The mixing ratio (weight ratio) between the toner and the carrier in the two-component developer is preferably from 1:100 to 30:100, and more preferably from 3:100 to 20:100 (toner:carrier).

Applications

The toner according to the exemplary embodiment may be a toner for light fixing, or may be a toner for heat fixing, but, in particular, is suitably used as a toner for light fixing. In addition, the toner according to the exemplary embodiment may be a colored toner including a colorant, or may be a transparent toner (so-called invisible toner) not including a colorant. Here, the invisible toner is, for example, a toner for forming an image for being decoded (read) using invisible light such as infrared rays, and means a toner which is less likely to be visually recognized (ideally, never recognized) in a case where a toner image is fixed on a recording medium (for example, paper, or the like).

Moreover, the invisible toner may include a colorant as long as the amount of the colorant added is at a level in which the presence of the colorant is unrecognized (for example, 1% by weight or less).

Hereinafter, an example of the image forming apparatus according to the exemplary embodiment will be described, but this image forming apparatus is not limited thereto. Moreover, major portions shown in the FIGURE will be described, and description of other portions will be omitted.

Image Forming Apparatus/Image Forming Method

An image forming apparatus and an image forming method according to the exemplary embodiment will be described.

The image forming apparatus according to the exemplary embodiment is equipped with an image holding member, a charging unit that charges a surface of the image holding member, an electrostatic charge image forming unit that forms an electrostatic charge image on the charged surface of the image holding member, a developing unit that contains an electrostatic charge image developer and develops the electrostatic charge image formed on the surface of the image holding member with the electrostatic charge image developer to form a toner image, a transfer unit that transfers the toner image formed on the surface of the image holding member onto a surface of a recording medium, and a fixing unit that fixes the toner image transferred onto the surface of the recording medium. In addition, as the electrostatic charge image developer, the electrostatic charge image developer according to the exemplary embodiment is applied.

In the image forming apparatus according to the exemplary embodiment, an image forming method (image forming method according to the exemplary embodiment) including a charging process of charging a surface of an image holding member, an electrostatic charge image forming process of forming an electrostatic charge image on the charged surface of the image holding member, a developing process of developing the electrostatic charge image formed on the surface of the image holding member with the electrostatic charge image developer according to the exemplary embodiment to form a toner image, a transfer process of transferring the toner image formed on the surface of the image holding member onto a surface of a recording medium, and a fixing process of fixing the toner image transferred onto the surface of the recording medium is performed.

As the image forming apparatus according to the exemplary embodiment, a known image forming apparatus is applied, such as a direct transfer-type apparatus that directly transfers a toner image formed on a surface of an image holding member onto a recording medium; an intermediate transfer-type apparatus that primarily transfers a toner image formed on a surface of an image holding member onto a surface of an intermediate transfer member, and secondarily transfers the toner image transferred onto the surface of the intermediate transfer member onto a surface of a recording medium; an apparatus that is provided with a cleaning unit that cleans a surface of an image holding member after transfer of a toner image and before charging; or an apparatus that is provided with an erasing unit that irradiates, after transfer of a toner image and before charging, a surface of an image holding member with erasing light for erasing.

In the case where the image forming apparatus according to the exemplary embodiment is an intermediate transfer-type apparatus, for example, the transfer unit includes a configuration of an intermediate transfer member having a surface onto which a toner image is to be transferred, a primary transfer unit that primarily transfers a toner image formed on a surface of an image holding member onto the surface of the intermediate transfer member, and a secondary transfer unit that secondarily transfers the toner image transferred onto the surface of the intermediate transfer member onto a surface of a recording medium.

Moreover, in the image forming apparatus according to the exemplary embodiment, for example, a part including the developing unit may have a cartridge structure (process cartridge) that is detachable from the image forming apparatus. As the process cartridge, for example, a process cartridge that contains the electrostatic charge image developer according to the exemplary embodiment and is equipped with a developing unit is suitably used.

In the image forming apparatus and the image forming method in the exemplary embodiment, fixing of a toner image onto a recording medium is preferably performed by light fixing by light irradiation. Moreover, pressure-fixing•heating-fixing using a heating member and light fixing by light irradiation may be used in combination.

The fixing unit for employing a light fixing method for fixing by irradiation of a toner image with light may be a unit which performs fixing by light, and a light fixing device (flash fixing device) is used.

Examples of the light source used in the light fixing device include a typical halogen lamp, a mercury lamp, a flash lamp, and an infrared laser.

As the heating member, a heating roll fixer, an oven fixer, or the like is preferably used.

As the heating roll fixer, a heating roll type fixing device in which a pair of fixing rolls are arranged so as to be pressed against each other is generally used. For a pair of fixing rolls, for example, a heating roll and a pressure roll are provided to face each other, and a nip is formed by being press-contacted. In the heating roll, an elastic member layer (elastic layer) having heat resistance and oil resistance and a surface layer formed of a fluorine resin or the like are sequentially formed at a metallic hollow core metal core having a heater lamp in the inside, and in the pressure roll, an elastic member layer having heat resistance and oil resistance and a surface layer are sequentially formed at a metallic hollow core metal core having a heater lamp in the inside as necessary. By passing a recording medium on which a toner image is formed through a nip region formed by the heating roll and the pressure roll, the toner image is fixed.

Among these, the fixing unit may be a device that emits an infrared laser emitting laser light of 800 nm or greater. The infrared laser has excellent energy conversion efficiency, that is, luminous efficiency, and is likely to reduce the energy required for the fixing unit.

In addition, the specific squarylium-croconium compound has a maximum absorption wavelength in the wavelength region of 800 nm or greater, absorption efficiency of the infrared laser light by the infrared absorbent is improved, and the amount of the infrared absorbent which is added to a toner is easily reduced.

The FIGURE is a configuration diagram schematically showing an example of the image forming apparatus according to the exemplary embodiment. The image forming apparatus shown in the FIGURE performs toner image formation by a toner obtained by adding black to three colors of cyan, magenta, and yellow.

In the image forming apparatus shown in the FIGURE, the recording medium P wound in a roll shape is transported by a paper feeding roller 328, on one side on the recording medium P transported in this manner, four image forming units 312 (black (K), yellow (Y), magenta (M), and cyan (C)) are provided in parallel with each other toward the downstream side from the upstream side in the feeding direction of the recording medium P, and the fixing device 326 of a light fixing method is provided on the downstream side of the image forming unit 312.

An image forming unit 312K for black is an image forming unit of a known electrophotographic system. Specifically, a charger 316K, an exposure unit 318K, a developing unit 320K, a cleaner 322K are provided around a photoconductor 314K, and a transfer unit 324K is provided through a recording medium P. The same is applied to each of an image forming unit 312Y for yellow, an image forming unit 312M for magenta, and an image forming unit 312C for cyan.

Moreover, in the case of being used in black and white print, only black (K) may be provided as the image forming unit 312.

In the image forming apparatus shown in the FIGURE, by each of the image forming units 312K, 312Y, 312M, and 312C, toner images are sequentially transferred on the recording medium P which is pulled out from the roll state by a known electrophotoraphic system, and the toner images are subjected to light fixing by the fixing device 326, whereby an image is formed. At the position where the fixing apparatus 326 is provided, a heating roll pair (not shown) for fixing a toner image onto the recording medium P by pressing and heating across the recording medium P may be provided. By providing a heating device such as a heater in the roll, the heating roll pair is heated, and by contact of the toner image with the heating roll pair, the toner image is melted, and fixed on the recording medium P.

Process Cartridge/Toner Cartridge

The process cartridge according to the exemplary embodiment will be described.

The process cartridge according to the exemplary embodiment is equipped with a developing unit that contains the electrostatic charge image developer according to the exemplary embodiment and develops an electrostatic charge image formed on a surface of an image holding member with the electrostatic charge image developer to form a toner image, and is detachable from an image forming apparatus.

The process cartridge according to the exemplary embodiment is not limited to the above-described configuration, and may be configured to include a developing device, and if necessary, at least one selected from other units such as an image holding member, a charging unit, an electrostatic charge image forming unit, and a transfer unit.

Next, the toner cartridge according to the exemplary embodiment will be described.

The toner cartridge according to the exemplary embodiment contains the toner according to the exemplary embodiment and is detachable from an image forming apparatus. The toner cartridge contains a toner for replenishment for being supplied to the developing unit provided in the image forming apparatus.

Moreover, the image forming apparatus shown in the FIGURE is an image forming apparatus that has such a configuration that the toner cartridges (not shown) are detachable therefrom, and the developing devices 320K, 320Y, 320M, and 320C are connected to the toner cartridges corresponding to the respective developing devices (colors) through toner supply tubes not shown in the drawing, respectively. In addition, in a case where the toner contained in the toner cartridge runs low, the toner cartridge is replaced.

Examples

Hereinafter, the exemplary embodiment of the present invention will be described in more detail based on examples, but the exemplary embodiment of the present invention is not limited thereto. Moreover, "parts" and "%" are based on weight unless indicated otherwise.

Synthesis of Infrared Absorbent

Comparative Example 1

Synthesis of Infrared Absorbent (A1a)

An infrared absorbent (A1a) (simple substance of compound (A1a)) is synthesized according to the following scheme.

2,2,8,8-tetramethyl-3,6-nonadiyn-5-ol, cyclohexane, and manganese (IV) oxide are put into a three-neck flask, and the resultant is heated under stirring. The water generated during reaction is removed by azeotropic distillation. After the reaction ends, the reaction liquid is cooled, filtered under reduced pressure, and sufficiently washed with ethyl acetate. The filtrate is concentrated under reduced pressure, whereby a pale yellow intermediate 1 is obtained.

Sodium monohydrogen sulfide n-hydrate is dissolved in ethanol in a three-neck flask. Within a temperature range from 5° C. to 7° C., a mixture of the intermediate 1 and ethanol is added dropwise thereto. After stirring at 20° C., water is put into the reaction liquid, and the ethanol is removed by distillation under reduced pressure. Thereafter, tablet salt is added thereto to be saturated, and extraction is performed using ethyl acetate. The organic phase is washed with a saturated ammonium chloride, and concentrated under reduced pressure. Distillation under reduced pressure is performed on the residue, whereby an intermediate 2a is obtained as yellow liquid.

In a nitrogen atmosphere, the intermediate 2a and tetrahydrofuran are put into a three-neck flask, and a 1 M tetrahydrofuran solution of methylmagnesium bromide is added dropwise thereto. The reaction liquid is heated and refluxed. After the reaction ends, the resultant is cooled to 5° C., and an ammonium bromide aqueous solution is added dropwise thereto. The resultant is extracted with ethyl acetate, and concentrated under reduced pressure, whereby an intermediate 3a is obtained.

The intermediate 3a, squaric acid, cyclohexane, isobutanol, and pyridine are put into a three-neck flask, and the resultant is refluxed with heat. The water generated during reaction is removed by azeotropic distillation. After the reaction ends, the resultant is filtered under reduced pressure, and the filtrate is concentrated under reduced pressure. The residue is recrystallized from methanol, whereby a compound (A1a) is obtained. This is used as an infrared absorbent (A1a).

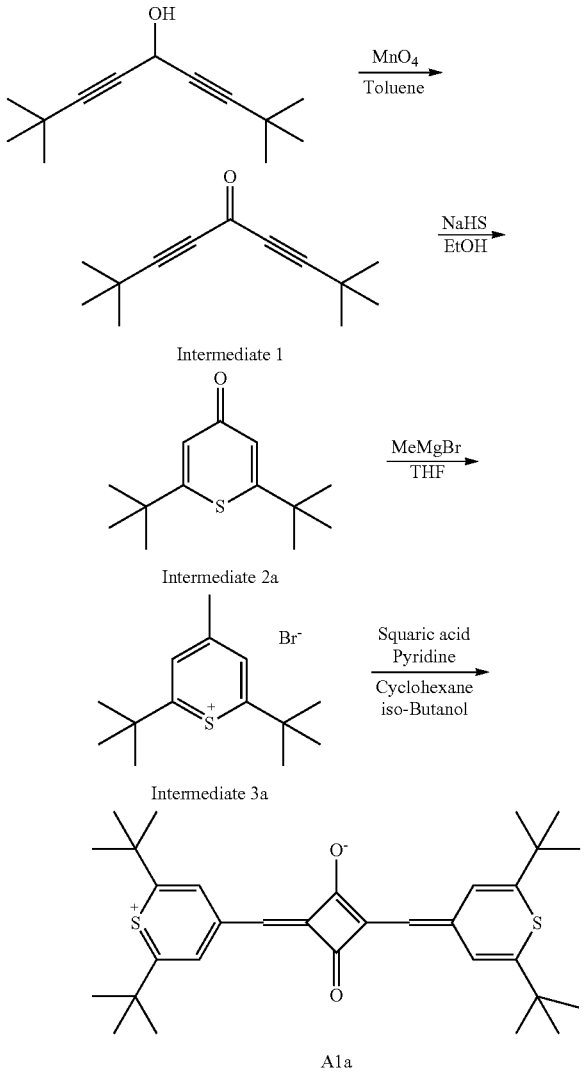

Comparative Example 2

Synthesis of Infrared Absorbent (A1c)

An infrared absorbent (A1c) (simple substance of compound (A1c)) is synthesized according to the following scheme.

The intermediate 1 obtained above is dissolved in methanol in a three-neck flask, and p-toluene sulfonic acid is added thereto. The mixture is refluxed with heat. After the reaction ends, the methanol is removed by distillation under reduced pressure. The resultant is diluted with ethyl acetate, washed with water and a saturated sodium bicarbonate water, and concentrated under reduced pressure. Distillation under reduced pressure is performed on the residue, whereby an intermediate 2c is obtained as yellow liquid.

In a nitrogen atmosphere, the intermediate 2c and tetrahydrofuran are put into a three-neck flask, and a 1 M tetrahydrofuran solution of methylmagnesium bromide is added dropwise thereto. The reaction liquid is heated and refluxed. After the reaction ends, the resultant is cooled to 5° C., and an ammonium bromide aqueous solution is added dropwise thereto. The resultant is extracted with ethyl acetate, and concentrated under reduced pressure, whereby an intermediate 3c is obtained.

The intermediate 3c, squaric acid, cyclohexane, isobutanol, and pyridine are put into a three-neck flask, and the resultant is refluxed with heat. The water generated during reaction is removed by azeotropic distillation. After the reaction ends, the resultant is filtered under reduced pressure, and the filtrate is concentrated under reduced pressure. The residue is recrystallized from methanol, whereby a compound (A1c) is obtained. This is used as an infrared absorbent (A1c).

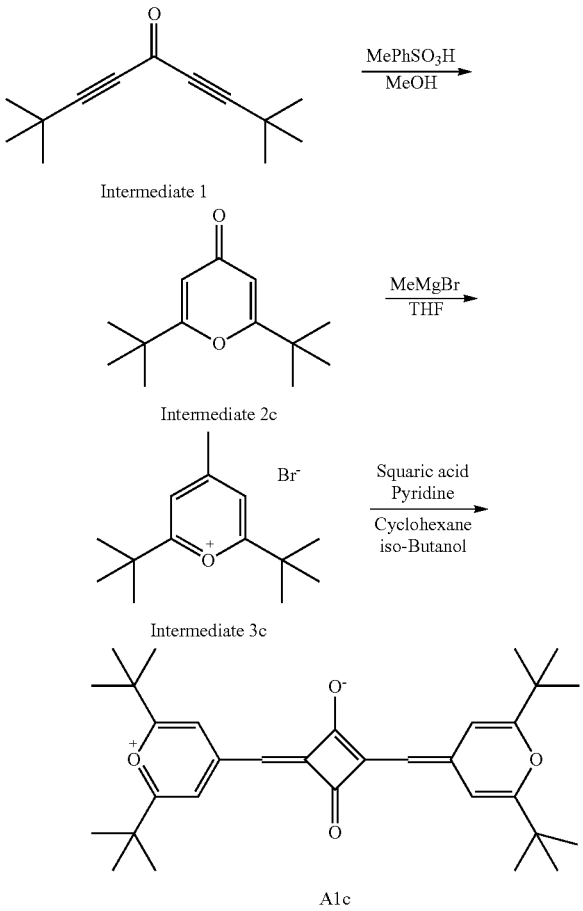

Example 1

Synthesis of Infrared Absorbent (A1-1)

An infrared absorbent (A1-1) (a mixture of the compound (A1a) and a compound (A1b)) is synthesized according to the following scheme.

The intermediates 3a and 3c are put into a three-neck flask in a ratio described in the following Table 1, then, squaric acid, cyclohexane, isobutanol, and pyridine are added thereto, and the resultant is refluxed with heat. The water generated during reaction is removed by azeotropic distillation. After the reaction ends, the resultant is filtered under reduced pressure, and the filtrate is concentrated under reduced pressure. The residue is recrystallized from methanol, whereby a mixture in which the compound (A1a) is a main component and the remainder is the compound (A1b) is obtained. This is designated as an infrared absorbent (A1-1).

The compositional ratio (weight ratio) is measured by the method described above using high performance liquid chromatography (HPLC) and confirmed. The compound (A1a) is 99.0%, the compound (A1b) is 1.0%, and the compound (A1c) is less than the detection limit.

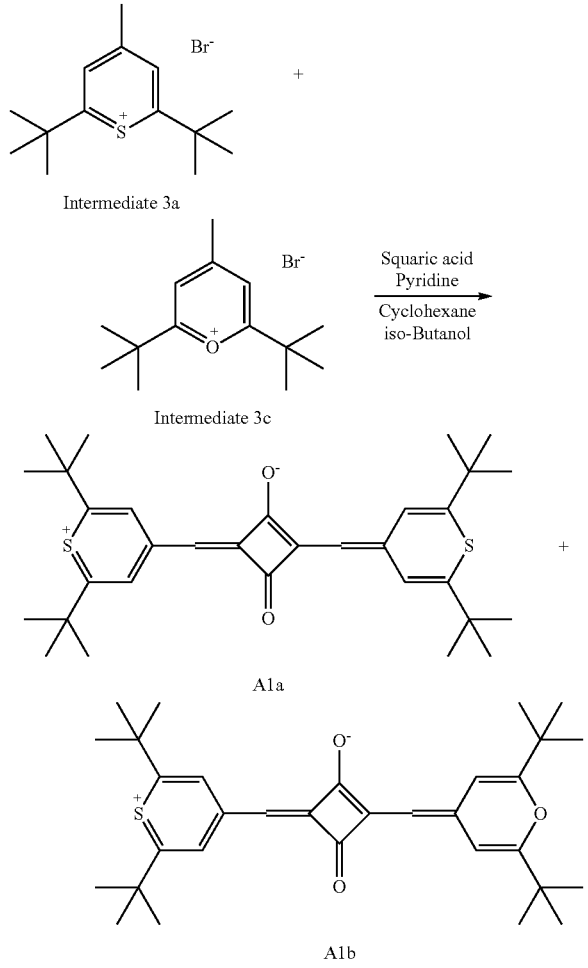

Examples 2 to 5

Synthesis of Infrared Absorbents (A1-2) to (A1-5)

Infrared absorbents (A1-2) to (A1-5) (a mixture of the compound (A1a) and the compound (A1b)) are obtained in the same manner as in the synthesis of the infrared absorbent (A1-1) except that the ratio between the intermediate 3a and the intermediate 3c is changed to the ratio described in the following Table 1.

Example 6

Preparation of Infrared Absorbent (A1-6)

The compound (A1a) obtained in the synthesis of the infrared absorbent (A1a) and the compound (A1c) obtained in the synthesis of the infrared absorbent (A1c) are mixed in a ratio of 97.0:3.0 (weight ratio), whereby a mixture in which the compound (A1a) is a main component and the remainder is the compound (A1c) is obtained. This is designated as an infrared absorbent (A1-6).

Synthesis of Resin Composition

Synthesis of Polyester Resin A

Bisphenol A bis(2-hydroxyethyl)ether: 347 parts

Ethylene glycol: 68 parts

Terephthalic acid: 166 parts

Isophthalic acid: 166 parts

Tetrabutoxytitanate (catalyst): 2 parts

The above materials are put into a three-neck flask dried by heating, then, nitrogen gas is put into the flask to maintain an inert atmosphere, and the temperature is raised while stirring. Thereafter, a co-condensation polymerization reaction is performed at 210° C. for 7 hours, then, the temperature is raised to 230° C. while slowly reducing the pressure to 1,333 Pa, and this state is maintained for 8 hours, whereby a resin A having an acid value of 10.0 mgKOH/g, a weight average molecular weight of 13,000, and a glass transition temperature of 62° C. is obtained.

The number average molecular weight (Mn) of the obtained polyester resin A is 5,100.

Preparation of Resin Composition Dispersion 0.080 g, 0.099 g, and 0.120 g of a tetrahydrofuran solution (concentration of 0.20% by weight) of the infrared absorbent (A1a) obtained above are weighed, and respectively added to 0.140 g of a tetrahydrofuran solution (concentration of 35.5% by weight) of the polyester resin A, whereby three types of infrared absorbent solutions having different concentrations are prepared.

In addition, for the infrared absorbents (A1c), (A1-1) to (A1-6) obtained above, three types of infrared absorbent solutions having different concentrations are prepared in the same manner.

Each solution is added dropwise to 9.7 g of a 0.05% by weight potassium carbonate aqueous solution stirred using ULTRA TURRAX (manufactured by IKA Japan, K.K.), whereby a resin composition dispersion of an infrared absorbent and the polyester resin A is obtained. The volume average particle diameter of each of the dispersions is 120 nm.

Preparation of Latex Patch

Using a glass filter with an inner diameter of 36 mm, the resin composition dispersion is filtered through MF-Millipore membrane filter (paper, manufactured by Merck & Co., Inc., model number VMWP) having a pore size of 50 nm, and the resultant is dried and heat-pressed (120° C.), whereby a latex patch is prepared.

Evaluation

Reflection Spectrum

For the latex patch obtained above, the reflection spectrum is measured using a spectrophotometer U-4100 manufactured by Hitachi, Ltd., whereby the infrared absorptivity at the infrared absorption peak of the latex patch is obtained.

Moreover, the infrared absorption peak indicates an infrared absorption peak of 820 nm of the compound (A1a) which is a main component, for the infrared absorbents (A1a) and (A1-1) to (A1-6), and an infrared absorption peak of 720 nm of the compound (A1c) which is a main component, for the infrared absorbent (A1c).

Color Difference

Next, for the obtained image, the color difference is measured as follows, and evaluation of color turbidity is performed.

The color difference (ΔE) refers to a color difference in the CIE1976L*a*b* color system. The color difference (ΔE) from a recording medium (in the example, the MF-Millipore membrane filter (model number VMWP)) is calculated by the following equation from L, a, and b values obtained by measurement using a reflection spectroscopic densitometer (X-RITE 939, manufactured by X-Rite Inc.).

$$\text{Color difference } \Delta E=((L_1-L_2)^2+(a_1-a_2)^2+(b_1-b_2)^2)^{1/2}$$

Here, $L_1$, $a_1$, and $b_1$ each represent an L value, an a value, and a b value of the recording medium surface before a latex patch is prepared. Here, $L_2$, $a_2$, and $b_2$ each represent an L value, an a value, and a b value of the image portion (resin composition portion) when a latex patch is prepared.

The color difference (ΔE) indicates that as the value is smaller, it is more difficult to be visually recognized, that is, means that the color turbidity is prevented.

Moreover, from the measured value of ΔE of each latex patch prepared using three types of infrared absorbent solutions having different concentrations, ΔE at which the infrared absorption ratio becomes 80% is obtained by calculation. With the content (% by weight) of the infrared absorbent in the resin composition when the infrared absorption ratio becomes 80%, the results are shown in the following Table 1.

TABLE 1

| | | | | | | | | Evaluation Infrared absorptivity at the time of 80% | |
|---|---|---|---|---|---|---|---|---|---|
| | Infrared | Intermediate | | Isolation | Target material (compound) | | | | Infrared absorbent |
| | absorbent | 3a | 3c | Yield | A1a | A1b | A1c | ΔE | content |
| Comparative Example 1 | A1a | 100% | — | 62% | 99.9% or greater | — | — | 3.45 | 2.28% by weight |
| Comparative Example 2 | A1c | — | 100% | 63% | — | — | 99.9% or greater | 3.80 | 2.51% by weight |
| Example 1 | A1-1 | 98.9% | 1.1% | 57% | 99.0% | 1.0% | — | 3.33 | 2.23% by weight |
| Example 2 | A1-2 | 97.6% | 2.4% | 56% | 97.9% | 2.1% | — | 3.20 | 2.19% by weight |
| Example 3 | A1-3 | 96.3% | 3.7% | 51% | 96.5% | 3.5% | — | 3.08 | 2.14% by weight |
| Example 4 | A1-4 | 90.6% | 9.4% | 47% | 90.7% | 9.3% | — | 3.30 | 2.26% by weight |
| Example 5 | A1-5 | 87.8% | 12.2% | 42% | 87.7% | 12.3% | — | 3.42 | 2.32% by weight |
| Example 6 | A1-6 | Prepared by mixing A1a and A1c compounds | | | 97.0% | — | 3.0% | 3.38 | 2.23% by weight |

"—" represents that the amount is less than detection limit.

Comparative Example 3

Synthesis of Infrared Absorbent (B1a)

By changing 2,2,8,8-tetramethyl-3,6-nonadiyn-5-ol used in synthesis of the intermediate 1 to 5,8-tridecadiyn-7-ol (that is, the following compound b), in synthesis of the infrared absorbent (A1a) in Comparative Example 1, an intermediate 4a in which two substituents substituted on the benzene ring in the intermediate 3a are changed from a tert-butyl group to a n-butyl group is synthesized. Next, using this intermediate 4a, the following compound (B1a) is obtained. This is designated as an infrared absorbent (B1a)

Examples 7 and 8

Synthesis of Infrared Absorbents (B1-1) and (B1-2)

By changing 2,2,8,8-tetramethyl-3,6-nonadiyn-5-ol used in synthesis of the intermediate 1 to 5,8-tridecadiyn-7-ol (that is, the following compound b), in synthesis of the infrared absorbent (A1c) in Comparative Example 2, an intermediate 4c in which two substituents substituted on the benzene ring in the intermediate 3c are changed from a tert-butyl group to a n-butyl group is synthesized.

Next, infrared absorbents (B1-1) and (B1-2) (a mixture of the compound (B1a) and the compound (B1b)) are obtained in the same manner as in the synthesis of the infrared absorbent (A1-1) in Example 1 except that the intermediate 3a and the intermediate 3c are changed to the intermediate 4a and the intermediate 4c obtained as described above, and the ratio between the intermediate 4a and the intermediate 4c is changed to the ratio described in the following Table 2.

Compound b

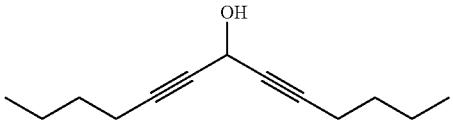

-continued

Intermediate 4a

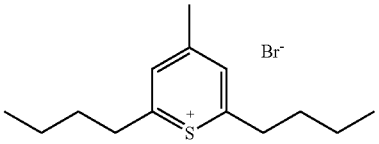

Intermediate 4c

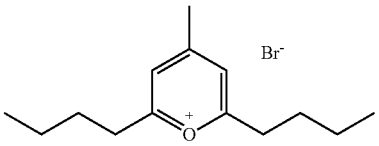

B1a

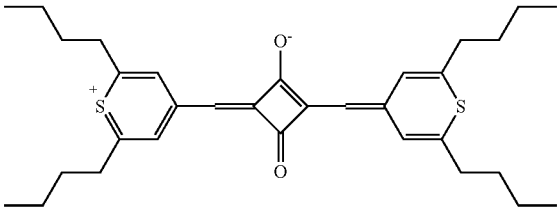

B1b

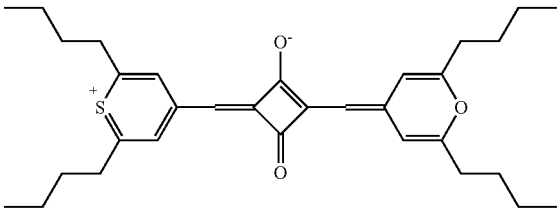

For each of Comparative Example 3 and Examples 7 and 8, a resin composition dispersion is prepared in the same manner as in Example 1, and evaluation is performed thereon.

TABLE 2

| | Infrared absorbent | Intermediate 4a | Intermediate 4c | Isolation Yield | Target material (compound) B1a | Target material (compound) B1b | Evaluation Infrared absorptivity at the time of ΔE | Evaluation Infrared absorptivity at the time of 80% Infrared absorbent content |
|---|---|---|---|---|---|---|---|---|
| Comparative Example 3 | B1a | 100% | — | 62% | 99.9% or greater | — | 3.45 | 2.26% by weight |
| Example 7 | B1-1 | 96.9% | 3.1% | 55% | 98.4% | 1.6% | 3.32 | 2.23% by weight |
| Example 8 | B1-2 | 94.4% | 5.6% | 51% | 97.0% | 3.0% | 3.21 | 2.19% by weight |

"—" represents that the amount is less than detection limit.

From Table 1, it is found that, in Examples 1 to 5 in which each of the infrared absorbents (A1-1) to (A1-5) which is a mixture of the compounds (A1a) and (A1b) is used and Example 6 in which the infrared absorbent (A1-6) which is a mixture of the compounds (A1a) and (A1c) is used, the value of the color difference (ΔE) is low, and the color turbidity is prevented, compared with Comparative Example 1 in which the infrared absorbent (A1a) is used and Comparative Example 2 in which the infrared absorbent (A1c) is used.

In addition, from the results shown in Table 2, it is found that, in Examples 7 and 8 in which each of the infrared absorbents (B1-1) and (B1-2) which is a mixture of the compounds (B1a) and (B1b) is used, the value of the color difference (ΔE) is low, and the color turbidity is prevented, compared with Comparative Example 3 in which the infrared absorbent (B1a) is used.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic charge image developing toner comprising a resin composition, the resin composition comprising:

a resin;

at least one selected from the group consisting of compounds represented by the following formula (I-1); and at least one selected from the group consisting of compounds represented by the following formula (I-2) and compounds represented by the following formula (I-3):

Formula (I-1)

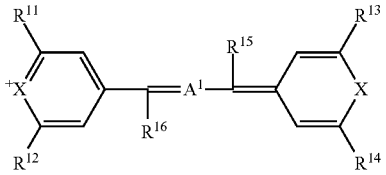

Formula (I-2)

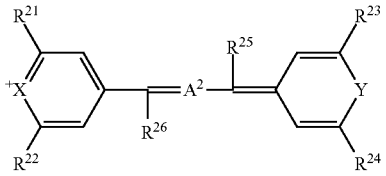

Formula (I-3)

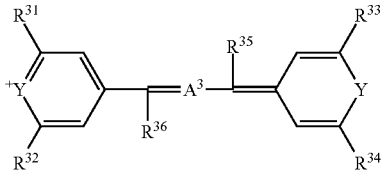

-continued

Formula (a1)

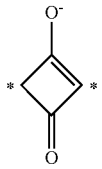

Formula (a2)

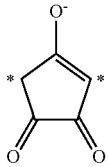

wherein $R^{11}$, $R^{12}$, $R^{13}$, $R^{14}$, $R^{21}$, $R^{22}$, $R^{23}$, $R^{24}$, $R^{31}$, $R^{32}$, $R^{33}$, and $R^{34}$ each independently represent a hydrogen atom, an alkyl group, an alkoxy group, an aryl group, or an aralkyl group, $R^{15}$, $R^{16}$, $R^{25}$, $R^{26}$, $R^{35}$, and $R^{36}$ each independently represent a hydrogen atom or an alkyl group, X represents an oxygen atom, a sulfur atom, a selenium atom, or a tellurium atom, with the proviso that a plurality of X's each represent the same element, Y represents an oxygen atom, a sulfur atom, a selenium atom, or a tellurium atom, with the proviso that a plurality of Y's each represent the same element, which is an element different from the element selected as X, $A^1$, $A^2$, and $A^3$ each independently represent a divalent group represented by formula (a1) or (a2), and the divalent group represented by formula (a1) or (a2) is bonded at * positions.

2. The electrostatic charge image developing toner according to claim 1, wherein a total content of the at least one compound selected from the group consisting of compounds represented by formula (I-1) and the at least one compound selected from the group consisting of compounds represented by formula (I-2) and compounds represented by formula (I-3) contained in the resin composition is 0.01% by weight to 5% by weight.

3. The electrostatic charge image developing toner according to claim 1, wherein a weight average particle diameter of the compounds composed of the at least one compound selected from the group consisting of compounds represented by formula (I-1) and the at least one compound selected from the group consisting of compounds represented by formula (I-2) and compounds represented by formula (I-3) in the resin composition is from 10 nm to 1,000 nm.

4. The electrostatic charge image developing toner according to claim 1, wherein the resin includes at least a polyester resin having a glass transition temperature of from 50° C. to 80° C. and a weight average molecular weight of from 5,000 to 1,000,000.

5. The electrostatic charge image developing toner according to claim 1, wherein X in formulas (I-1), (I-2), and (I-3) represents one of an oxygen atom and a sulfur atom, and Y in formulas (I-1), (I-2), and (I-3) represents the other one of an oxygen atom and a sulfur atom.

6. The electrostatic charge image developing toner according to claim 1, wherein a ratio of the compound represented by formula (I-1) or a ratio of the compound represented by formula (I-2) is from 85.0% by weight to 99.9% by weight with respect to a total of the compound represented by formula (I-1), the compound represented by formula (I-2), and the compound represented by formula (I-3).

7. An electrostatic charge image developer, comprising:

the electrostatic charge image developing toner according to claim 1.

* * * * *